US011193192B2

(12) United States Patent
Bull et al.

(10) Patent No.: US 11,193,192 B2
(45) Date of Patent: Dec. 7, 2021

(54) ALUMINUM ALLOY PRODUCTS AND A METHOD OF PREPARATION

(71) Applicant: NOVELIS INC., Atlanta, GA (US)

(72) Inventors: Michael Bull, Brighton, MI (US); Rajeev G. Kamat, Marietta, GA (US)

(73) Assignee: NOVELIS INC., Atlanta, GA (US)

( * ) Notice: Subject to any disclaimer, the term of this patent is extended or adjusted under 35 U.S.C. 154(b) by 170 days.

(21) Appl. No.: 14/924,956

(22) Filed: Oct. 28, 2015

(65) Prior Publication Data

US 2016/0115575 A1 Apr. 28, 2016

Related U.S. Application Data

(60) Provisional application No. 62/069,569, filed on Oct. 28, 2014.

(51) Int. Cl.

| | |
|---|---|
| ***C22C 21/08*** | (2006.01) |
| ***C22F 1/043*** | (2006.01) |
| ***C22C 21/02*** | (2006.01) |
| ***B22D 21/00*** | (2006.01) |
| ***B22D 7/00*** | (2006.01) |
| ***B22D 15/00*** | (2006.01) |
| ***C22F 1/047*** | (2006.01) |
| ***C22F 1/057*** | (2006.01) |
| ***C22C 21/14*** | (2006.01) |
| ***C22C 21/16*** | (2006.01) |
| *C22F 1/05* | (2006.01) |

(52) U.S. Cl.

CPC ..... *C22F 1/043* (2013.01); *B22D 7/005* (2013.01); *B22D 15/00* (2013.01); *B22D 21/007* (2013.01); *C22C 21/02* (2013.01); *C22C 21/08* (2013.01); *C22C 21/14* (2013.01); *C22C 21/16* (2013.01); *C22F 1/047* (2013.01); *C22F 1/057* (2013.01)

(58) Field of Classification Search

CPC ..... C22F 1/05; C22C 21/08

See application file for complete search history.

(56) References Cited

U.S. PATENT DOCUMENTS

| | | | |
|---|---|---|---|
| 4,082,578 | A | 4/1978 | Evancho et al. |
| 4,174,232 | A | 11/1979 | Lenz et al. |
| 4,614,552 | A | 9/1986 | Fortin et al. |

(Continued)

FOREIGN PATENT DOCUMENTS

| | | | |
|---|---|---|---|
| CN | 101545063 | A | 9/2009 |
| CN | 101960031 | | 1/2011 |

(Continued)

OTHER PUBLICATIONS

Davis, J.R. "Metals Handbook Desk Edition", 2nd edition, 1998, p. 423-426,460-464. (Year: 1998).*

(Continued)

*Primary Examiner* — George Wyszomierski
*Assistant Examiner* — Janell C Morillo
(74) *Attorney, Agent, or Firm* — Kilpatrick Townsend & Stockton LLP

(57) ABSTRACT

The present invention relates to aluminum alloy products that can be riveted and possess excellent ductility and toughness properties. The present invention also relates to a method of producing the aluminum alloy products. In particular, these products have application in the automotive industry.

11 Claims, 20 Drawing Sheets

(56) References Cited

U.S. PATENT DOCUMENTS

| | | | | |
|---|---|---|---|---|
| 5,616,189 | A * | 4/1997 | Jin | C22C 21/02 148/416 |
| 6,267,922 | B1 * | 7/2001 | Bull | C22C 21/08 420/534 |
| 6,423,164 | B1 | 7/2002 | Bryant et al. | |
| 6,613,167 | B2 | 9/2003 | Magnusen et al. | |
| 6,780,259 | B2 | 8/2004 | Bull et al. | |
| 10,533,243 | B2 | 1/2020 | Newman et al. | |
| 10,550,455 | B2 | 2/2020 | Hosch et al. | |
| 2003/0015261 | A1 | 1/2003 | Bull et al. | |
| 2005/0028894 | A1 | 2/2005 | Hoffmann et al. | |
| 2005/0288894 | A1 | 12/2005 | Vorenkamp et al. | |

FOREIGN PATENT DOCUMENTS

| | | | |
|---|---|---|---|
| CN | 102732760 | A | 10/2012 |
| CN | 103045918 | A | 4/2013 |
| CN | 103060632 | A | 4/2013 |
| EP | 0961841 | A1 | 12/1999 |
| JP | 09031616 | A * | 2/1997 |
| JP | H09031616 | A | 2/1997 |
| JP | 2000144294 | A | 5/2000 |
| JP | 2003268472 | A | 9/2003 |
| JP | 2004238657 | | 8/2004 |
| JP | 2017520936 | | 7/2017 |
| KR | 20110031898 | | 3/2011 |
| RU | 2276696 | | 5/2006 |
| WO | 9603531 | A1 | 2/1996 |
| WO | 9711203 | | 3/1997 |
| WO | 0003052 | A1 | 1/2000 |
| WO | 2007076980 | A1 | 7/2007 |

OTHER PUBLICATIONS

Canadian Patent Application No. 2,962,629, Office Action dated Apr. 9, 2018, 5 pages.
Japanese Patent Application No. 2017-520936, Office Action dated Mar. 27, 2018, 10 pages.
Chinese Patent Application No. CN 201580053541.3, Office Action dated Dec. 5, 2017, 22 pages.
Starke, E. A., Jr., et al., "Application of modern aluminum alloys to aircraft," Progress in Aerospace Sciences, 1996, pp. 131-172, vol. 32, Issues 2-3, Elsevier.
"Lagerhauser Aarau Logistik-Center Hunzenschwil: J57S& J73A—not only the "inner values"," Dec. 2008, Novelis Deutschland GmbH, Germany.
"Samsung Medical Center Seoul: J73A—clean lines of architecture," Dec. 2008, Novelis Deutschland GmbH, Germany.
"Santander Bank Queretaro: J73A—for double-skin-facades," Dec. 2008, Novelis Deutschland GmbH, Germany.
"Students Hall Dresden: J73A—for high-quality refurbishment," Dec. 2008, Novelis Deutschland GmbH, Germany.
"International Alloy Designations and Chemical Composition Limits for Wrought Aluminum and Wrought Aluminum Alloys," Registration Record Series: Teal Sheets, Feb. 1, 2009, The Aluminum Association, Inc., 35 pages.
"Novelis B57S Product datasheet," Release 8, Jul. 2009, Novelis Deutschland GmbH, Germany.
"Novelis B73A Product datasheet," Release 8, Jul. 2009, Novelis Deutschland GmbH, Germany.
"Novelis J57S Product datasheet," Release 8, Jul. 2009, Novelis Deutschland GmbH, Germany.
"Novelis J73A Product datasheet," Release 8, Jul. 2009, Novelis Deutschland GmbH, Germany.
"SSL—Stainless Steel Look, Substrate—Alloy AlMg1 H14," Jan. 2010, Novelis Deutschland GmbH, Germany.
"ASTM B831-11: Standard Test Method for Shear Testing of Thin Aluminium Alloy Products," Jan. 2012, ASTM International, West Conshohocken, PA, 4 pages.
"ASTM B831-14: Standard Test Method for Shear Testing of Thin Aluminium Alloy Products," Jul. 2014, ASTM International, West Conshohocken, PA, 5 pages.
International Patent Application No. PCT/US2015/057720, International Search Report and Wiillen Opinion dated Jan. 29, 2016, 14 pages.
International Patent Application No. PCT/US2015/057720, International Preliminary Reporton Patentability dated May 11, 2017, 10 pages.
Australian Application No. 2015339363 , "First Examiner Report", dated May 4, 2018, 4 pages.
European Application No. 15790789.0 , "Office Action", dated Apr. 19, 2018, 4 pages.
Bin , "Effects of Mn on Microstructures and Mechanical Properties of 6061 Aluminum Alloy", Chinese Master's Theses Full-Text Database Engineering Science and Technology I, No. 6, Jun. 15, 2014, pp. 10-39.
Chinese Pat. Appl. No. CN 201580053541.3, Office Action dated Aug. 2, 2018, 26 pages.
Korean Pat. Appl. No. 10-2017-7014356, Office Action dated Aug. 16, 2018, 16 pages.
Lodgaard et al., "Precipitation of Dispersoids Containing Mn and/or Cr in Al—Mg—Si Alloys", Materials Science and Engineering: A, vol. 283, No. 1-2, May 15, 2000, pp. 144-152.
Renming et al., "Study on Distribution of Dispersion Particles Containing Mn in Al—Mg—Si—Mn Alloy During Homogenization", Hot Working Technology, vol. 37, No. 18, Sep. 25, 2008, pp. 21-24.
Yuanyuan et al., "Novel Material Science and Technology—Volume of Metal Materials", Guangzhou: South China University of Technology Press, Sep. 30, 2012, pp. 397.
Russian Application No. 2017115338 , "Office Action", dated Jun. 14, 2018, 8 pages.
Australian Patent Application No. 2015339363 , "Examination Report No. 2", dated Sep. 21, 2018, 5 pages.
European Patent Application No. 15790789.0 , "Office Action", dated Oct. 25, 2018, 4 pages.
Russian Application No. 2017115338 , "Office Action", dated Nov. 2, 2018, 9 pages.
Chinese Patent Application No. 201580053541.3, Office Action dated Feb. 1, 2019, 16 pages.
Korean Patent Application No. 10-2017-7014356, Office Action dated Jan. 9, 2019, 5 pages.
European Application No. 15790789.0, "Office Action", dated Apr. 12, 2019, 4 pages.
Russian Application No. 2017115338, "Notice of Decision to Grant", dated Mar. 28, 2019, 14 pages.
Canadian Application No. 2,962,629 , "Office Action", dated Jul. 25, 2019, 4 pages.
European Application No. 15790789.0 , "Summons to Attend Oral Proceedings", Aug. 2, 2019, 5 pages.
Egypt Application No. PCT 644/2017 , "Office Action", dated Feb. 15, 2020, 5 pages.
European Application No. 15790789.0 , "Notice of Decision to Grant", dated Mar. 26, 2020, 2 pages.
Japanese Application No. 2017-520936 , "Office Action", dated Mar. 17, 2020, 6 pages.
Korean Application No. 10-2017-7014356 , "Office Action", dated Jan. 16, 2020, 4 pages.
Canadian Application No. 2,962,629 , "Office Action", dated Apr. 22, 2020, 4 pages.
Korean Application No. 10-2017-7014356, "Office Action", dated May 13, 2020, 11 pages.
European Application No. EP20170075.4, Extended European Search Report dated Jul. 10, 2020, 9 pages.
Indian Application No. IN201717013706, Office Action dated May 29, 2020, 8 pages.
Canadian Application No. 2,962,629 , "Office Action", dated Dec. 6, 2018, 5 pages.
Japanese Application No. 2017-520936 , "Office Action", dated Nov. 27, 2018, 13 pages.
Japanese Application No. 2017-520936, Trial and Appeal Decision to Grant, dated Sep. 8, 2020, 2 pages.

(56) References Cited

OTHER PUBLICATIONS

Korean Application No. 10-2017-7014356, Notice of Decision to Grant, dated Aug. 13, 2020, 1 page.
Chinese Application No. 201911027950.2, Office Action, dated Dec. 22, 2020, 34 pages.
European Application No. 15790789.0, "Notice of Opposition", dated Jan. 28, 2021, 18 pages.
European Application No. 15790789.0, "Notices of Opposition", dated Feb. 10, 2021, 3 pages.
Canadian Application No. 2,962,629, Notice of Allowance, dated Nov. 17, 2020, 1 page.
Brazilian Patent Application No. 1120170062712 , Office Action dated Mar. 30, 2021, 6 pages.
Brazilian Application No. 1120170062712, Notice of Allowance, dated Jul. 13, 2021.
European Application No. 20170075.4, Office Action, dated Jun. 10, 2021, 5 pages.
Japanese Application No. 2020-103156, Office Action, dated Jul. 20, 2021, 9 pages.
Brazilian Application No. 122020002890-4, Office Action, dated Jul. 22, 2021, 6 pages.
Chinese Application No. 201580053541.3, Office Action, dated Jul. 5, 2021, 20 pages.
Chinese Application No. 201911027950.2 , Office Action, dated Aug. 9, 2021, 27 pages.

* cited by examiner

ALUMINUM ALLOY PRODUCTS AND A METHOD OF PREPARATION

CROSS-REFERENCE TO RELATED APPLICATION

This application claims the benefit of U.S. Provisional Patent Application No. 62/069,569, filed Oct. 28, 2014, which is incorporated by reference herein in its entirety.

FIELD OF THE INVENTION

The present invention relates to aluminum alloy products that have very good formability in the T4 temper and particularly high toughness and ductility in the high strength tempers (e.g., the T6, T8 and T9 tempers). The ductility and toughness are such that the alloy can be riveted in these high strength tempers and possess excellent ductility and toughness properties in their intended service. The present invention also relates to a method of producing the aluminum alloy products. In particular, these products have application in the automotive industry.

BACKGROUND

Body parts for many vehicles are fabricated from several body sheets. To date in the automotive industry, these sheets have been mostly made of steel. However, more recently there has been a trend in the automotive industry to replace the heavier steel sheets with lighter aluminum sheets.

To be acceptable for automobile body sheets, however, aluminum alloys must not only possess requisite characteristics of strength and corrosion resistance, for example, but must also exhibit good ductility and toughness. These characteristics are important as automotive body sheets need to be attached or combined to other sheets, panels, frames, and the like. Methods of attaching or combining sheets include resistance spot welding, self-piercing riveting, adhesive bonding, hemming, and the like.

Self-piercing riveting is a process in which a self-pierce rivet fully pierces the top sheet, but only partially pierces the bottom sheet. The tail end of the rivet does not break through the bottom sheet, and as a result, provides a water or gas-tight joint between the top and bottom sheets. Furthermore, the tail end of the rivet flares and interlocks into the bottom sheet forming a low profile button. To ensure maximum joint strength and in-service integrity and durability, the deformed aluminum sheet material must be essentially free from all defects. These defects may include internal voids or cracks, external cracks, or significant surface crazing. Since there are many combinations of sheet thicknesses and rivet types, each of which must be "tuned" to the production situation, it is not practical to use riveting per se as an assessment of the material's ductility and toughness. A close surrogate for the deformation that the material experiences during the riveting is to subject the material, in the intended service strength, to a bending operation. Hence, by subjecting the material to this bending operation, the material can be ranked as to its ability to be riveted, or to be sufficiently ductile or tough in the intended service. Full conformation is conducted with the actual riveting and crash performance. To date, the bending data have correlated sufficiently well to the actual service performance; thus, the bend test is the official release criterion by at least one Original Equipment Manufacturers (OEM). Other tests, such as the shear test, are also means of assessing the toughness.

With OEM's higher standards, self-piercing riveting requires metal sheets with sufficient ductility and toughness that meet requisite bending radius/sheet thickness (r/t) ratios. Having sufficient ductility is crucial because it ensures that the metal sheets can be riveted at a particular strength and can meet the general toughness requirements during a crash event. The material needs to retain sufficient ductility such that it deforms with a reasonable degree of plasticity, rather than by a rapid fracturing event. This is a particularly difficult requirement to meet. For example, it is generally known in the field that for bending aluminum alloys at similar strengths, the r/t ratio is usually between 2-4. To date, all material with an r/t ratio greater than 1 has exhibited very poor riveting behavior. Some acceptable riveted joints have been made with material exhibiting an r/t ratio of less than 0.6 (e.g., between 0.4 and 0.6). However, for the most difficult riveted joints, the material must exhibit an r/t ratio of less than 0.4. At an r/t ratio of 0.4, the outer fiber surface strains are in excess of 40%, which is a severe deformation requirement, previously unattainable at these high service strengths above 260 MPa yield strength (YS), and typically in the 280-300 MPa YS range. Since the actual service strength is typically in the 280-300 MPa YS range, this combination of strength and ductility is particularly difficult to obtain.

Therefore, there is a need for an automotive body sheet that can be riveted and meet ductility and toughness requirements during a crash event.

SUMMARY

Covered embodiments of the invention are defined by the claims, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification, any or all drawings and each claim.

The present invention solves the problems in the prior art and provides automotive aluminum sheets that have very good formability in the T4 temper and particularly high toughness and ductility in the high strength tempers, such as the T6, T8, and T9 tempers. The ductility and toughness is such that the alloy can be riveted in these high strength tempers and possess excellent ductility and toughness properties for their intended service. The ability to successfully rivet the material in these high strength tempers, which is generally also the service temper condition, is on its own a severe test of the toughness and ductility of the material since the rivet operation subjects the material to a very high strain and strain rate deformation process. Further, the present invention provides a process for preparing the automotive aluminum sheets. As a non-limiting example, the process of the present invention has particular application in the automotive industry.

In different embodiments, the alloys of the present invention can be used to make products in the form of extrusions, plates, sheets, and forgings.

Other objects and advantages of the invention will be apparent from the following detailed description of embodiments of the invention.

DETAILED DESCRIPTION

Figure 1:
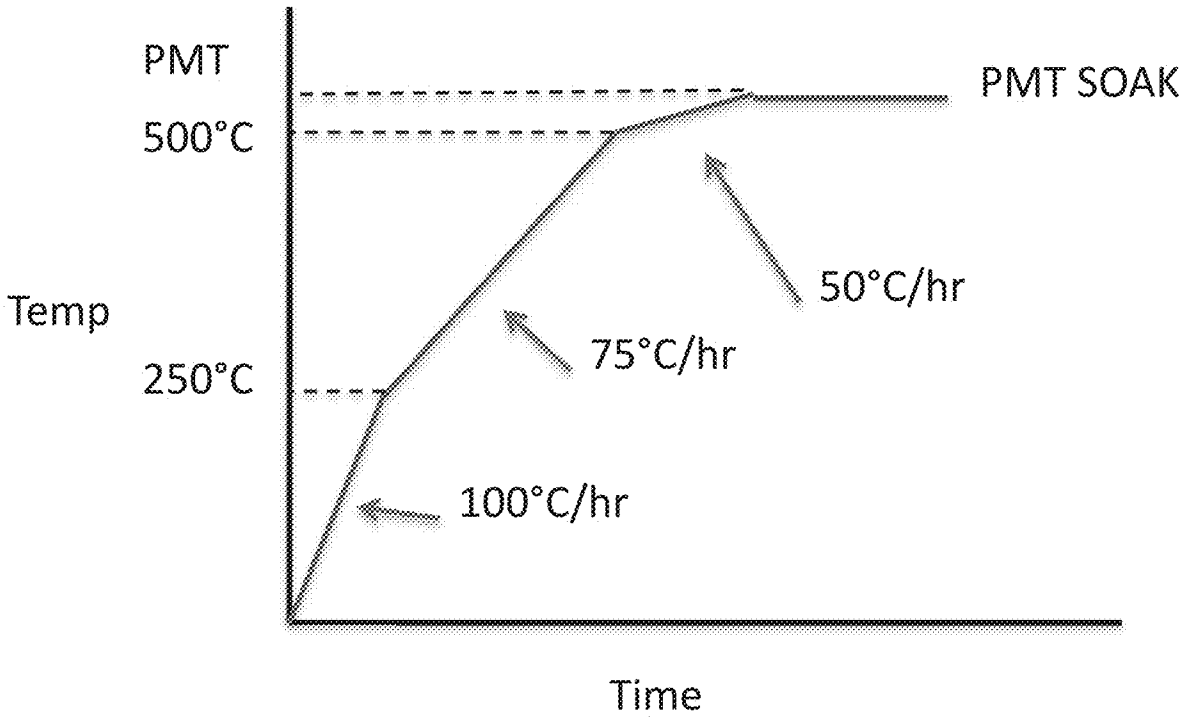
FIG. 1 is a schematic representation of heating rates employed in association with Example 1.

The present invention provides novel automotive aluminum sheets that can be riveted while meeting the ductility and toughness requirements during a crash event. Further, the present invention provides a process for preparing the automotive aluminum sheets.

The novel automotive aluminum sheets of the present invention are prepared by a novel process to ensure that: 1) the aluminum alloy content minimizes the soluble phases out of solution consistent with strength and toughness requirements, 2) the alloy contains sufficient dispersoids to reduce strain localization and to uniformly distribute the deformation, and 3) the insoluble phases are adjusted to the appropriate level to be consistent with achieving the target grain size and morphology in industrial automotive applications.

Definitions and Descriptions:

As used herein, the terms "invention," "the invention," "this invention" and "the present invention" are intended to refer broadly to all of the subject matter of this patent application and the claims below. Statements containing these terms should be understood not to limit the subject matter described herein or to limit the meaning or scope of the patent claims below.

In this description, reference is made to alloys identified by AA numbers and other related designations, such as "series" or "6xxx." For an understanding of the number designation system most commonly used in naming and identifying aluminum and its alloys, see "International Alloy Designations and Chemical Composition Limits for Wrought Aluminum and Wrought Aluminum Alloys" or "Registration Record of Aluminum Association Alloy Designations and Chemical Compositions Limits for Aluminum Alloys in the Form of Castings and Ingot," both published by The Aluminum Association.

As used herein, the meaning of "a," "an," and "the" includes singular and plural references unless the context clearly dictates otherwise.

In the following embodiments, the aluminum alloys are described in terms of their elemental composition in weight percent (wt. %). In each alloy, the remainder is aluminum, with a maximum wt. % of 0.1% for all impurities.

Aluminum Sheets

The aluminum sheets described herein can be prepared from heat-treatable alloys. In a first embodiment, the automotive aluminum sheet is a heat-treatable alloy of the following composition:

| Constituent | Range (wt. %) |
|---|---|
| Cu | 0.40-0.80 |
| Fe | 0-0.40 |
| Mg | 0.40-0.90 |
| Mn | 0-0.40 |
| Si | 0.40-0.70 |
| Ti | 0-0.20 |
| Zn | 0-0.10 |
| Cr | 0-0.20 |
| Pb | 0-0.01 |
| Be | 0-0.001 |
| Ca | 0-0.008 |
| Cd | 0-0.04 |
| Li | 0-0.003 |
| Na | 0-0.003 |
| Zr | 0-0.2 |
| Sc | 0-0.2 |
| V | 0-0.2 |
| Trace element impurities | 0-0.10 |
| Aluminum | Remainder |

In some embodiments, the heat-treatable alloy as described herein includes copper (Cu) in an amount of from 0.40% to 0.80% (e.g., from 0.45% to 0.75%, from 0.45% to 0.65%, from 0.50% to 0.60%, from 0.51% to 0.59%, from 0.50% to 0.54%, or from 0.68% to 0.72%) based on the total weight of the alloy. For example, the alloy can include 0.40%, 0.41%, 0.42%, 0.43%, 0.44%, 0.45%, 0.46%, 0.47%, 0.48%, 0.49%, 0.50%, 0.51%, 0.52%, 0.53%, 0.54%, 0.55%, 0.56%, 0.57%, 0.58%, 0.59%, 0.60%, 0.61%, 0.62%, 0.63%, 0.64%, 0.65%, 0.66%, 0.67%, 0.68%, 0.69%, 0.70%, 0.71%, 0.72%, 0.73%, 0.74%, 0.75%, 0.76%, 0.77%, 0.78%, 0.79%, or 0.80% Cu. All expressed in wt. %.

In some embodiments, the heat-treatable alloy as described herein includes iron (Fe) in an amount of from 0% to 0.4% (e.g., from 0.1% to 0.35%, from 0.1% to 0.3%, from 0.22% to 0.26%, from 0.17% to 0.23%, or from 0.18% to 0.22%) based on the total weight of the alloy. For example, the alloy can include 0.01%, 0.02%, 0.03%, 0.04%, 0.05%, 0.06%, 0.07%, 0.08%, 0.09%, 0.10%, 0.11%, 0.12%, 0.13%, 0.14%, 0.15%, 0.16%, 0.17%, 0.18%, 0.19%, 0.20%, 0.21%, 0.22%, 0.23%, 0.24%, 0.25%, 0.26%, 0.27%, 0.28%, 0.29%, 0.30%, 0.31%, 0.32%, 0.33%, 0.34%, 0.35%, 0.36%, 0.37%, 0.38%, 0.39%, or 0.40% Fe. All expressed in wt. %.

In some embodiments, the heat-treatable alloy as described herein includes magnesium (Mg) in an amount of from 0.40% to 0.90% (e.g., from 0.45% to 0.85%, from 0.5% to 0.8%, from 0.66% to 0.74%, from 0.54% to 0.64%, from 0.71% to 0.79%, or from 0.66% to 0.74%) based on the total weight of the alloy. For example, the alloy can include 0.40%, 0.41%, 0.42%, 0.43%, 0.44%, 0.45%, 0.46%, 0.47%, 0.48%, 0.49%, 0.50%, 0.51%, 0.52%, 0.53%, 0.54%, 0.55%, 0.56%, 0.57%, 0.58%, 0.59%, 0.60%, 0.61%, 0.62%, 0.63%, 0.64%, 0.65%, 0.66%, 0.67%, 0.68%, 0.69%, 0.70%, 0.71%, 0.72%, 0.73%, 0.74%, 0.75%, 0.76%, 0.77%, 0.78%, 0.79%, 0.80%, 0.81%, 0.82%, 0.83%, 0.84%, 0.85%, 0.86%, 0.87%, 0.88%, 0.89%, 0.90% Mg. All expressed in wt. %.

In some embodiments, the heat-treatable alloy as described herein includes manganese (Mn) in an amount of from 0% to 0.4% (e.g., from 0.01% to 0.4%, from 0.1% to 0.35%, from 0.15% to 0.35%, from 0.18% to 0.22%, from 0.10% to 0.15%, from 0.28% to 0.32%, or from 0.23% to 0.27%) based on the total weight of the alloy. For example, the alloy can include 0.01%, 0.02%, 0.03%, 0.04%, 0.05%, 0.06%, 0.07%, 0.08%, 0.09%, 0.10%, 0.11%, 0.12%, 0.13%, 0.14%, 0.15%, 0.16%, 0.17%, 0.18%, 0.19%, 0.20%, 0.21%, 0.22%, 0.23%, 0.24%, 0.25%, 0.26%, 0.27%, 0.28%, 0.29%, 0.30%, 0.31%, 0.32%, 0.33%, 0.34%, 0.35%, 0.36%, 0.37%, 0.38%, 0.39%, or 0.40% Mn. All expressed in wt. %.

In some embodiments, the heat-treatable alloy as described herein includes silicon (Si) in an amount of from 0.40% to 0.70% (e.g., from 0.45% to 0.65%, from 0.57% to 0.63%, from 0.55% to 0.6%, or from 0.52% to 0.58%) based on the total weight of the alloy. For example, the alloy can include 0.40%, 0.41%, 0.42%, 0.43%, 0.44%, 0.45%, 0.46%, 0.47%, 0.48%, 0.49%, 0.50%, 0.51%, 0.52%, 0.53%, 0.54%, 0.55%, 0.56%, 0.57%, 0.58%, 0.59%, 0.60%, 0.61%, 0.62%, 0.63%, 0.64%, 0.65%, 0.66%, 0.67%, 0.68%, 0.69%, or 0.70% Si. All expressed in wt. %.

In some embodiments, the heat-treatable alloy as described herein includes titanium (Ti) in an amount of from 0% to 0.2% (e.g., from 0.05% to 0.15%, from 0.05% to 0.12%, or from 0% to 0.08%) based on the total weight of the alloy. For example, the alloy can include 0.01%, 0.02%, 0.03%, 0.04%, 0.05%, 0.06%, 0.07%, 0.08%, 0.09%, 0.10%, 0.11%, 0.12%, 0.13%, 0.14%, 0.15%, 0.16%, 0.17%, 0.18%, 0.19%, or 0.20% Ti. In some embodiments, Ti is not present in the alloy (i.e., 0%). All expressed in wt. %.

In some embodiments, the heat-treatable alloy as described herein includes zinc (Zn) in an amount of from 0% to 0.1% (e.g., from 0.01% to 0.1% or from 0% to 0.05%) based on the total weight of the alloy. For example, the alloy can include 0.01%, 0.02%, 0.03%, 0.04%, 0.05%, 0.06%, 0.07%, 0.08%, 0.09%, or 0.10% Zn. In some embodiments, Zn is not present in the alloy (i.e., 0%). All expressed in wt. %.

In some embodiments, the heat-treatable alloy as described herein includes chromium (Cr) in an amount of from 0% to 0.2% (e.g., from 0.02% to 0.18%, from 0.02% to 0.14%, from 0.06% to 0.1%, from 0.03% to 0.08%, or from 0.10% to 0.14%) based on the total weight of the alloy. For example, the alloy can include 0.01%, 0.02%, 0.03%, 0.04%, 0.05%, 0.06%, 0.07%, 0.08%, 0.09%, 0.10%, 0.11%, 0.12%, 0.13%, 0.14%, 0.15%, 0.16%, 0.17%, 0.18%, 0.19%, or 0.20% Cr. In some embodiments, Cr is not present in the alloy (i.e., 0%). All expressed in wt. %.

In some embodiments, the heat-treatable alloy as described herein includes lead (Pb) in an amount of from 0% to 0.01% (e.g., from 0% to 0.007% or from 0% to 0.005%) based on the total weight of the alloy. For example, the alloy can include 0.001%, 0.002%, 0.003%, 0.004%, 0.005%, 0.006%, 0.007%, 0.008%, 0.009%, or 0.010% Pb. In some embodiments, Pb is not present in the alloy (i.e., 0%). All expressed in wt. %.

In some embodiments, the heat-treatable alloy as described herein includes beryllium (Be) in an amount of from 0% to 0.001% (e.g., from 0% to 0.0005%, from 0% to 0.0003%, or from 0% to 0.0001%) based on the total weight of the alloy. For example, the alloy can include 0.0001%, 0.0002%, 0.0003%, 0.0004%, 0.0005%, 0.0006%, 0.0007%, 0.0008%, 0.0009%, or 0.0010% Be. In some embodiments, Be is not present in the alloy (i.e., 0%). All expressed in wt. %.

In some embodiments, the heat-treatable alloy as described herein includes calcium (Ca) in an amount of from 0% to 0.008% (e.g., from 0% to 0.004%, from 0% to 0.001%, or from 0% to 0.0008%) based on the total weight of the alloy. For example, the alloy can include 0.0001%, 0.0002%, 0.0003%, 0.0004%, 0.0005%, 0.0006%, 0.0007%, 0.0008%, 0.0009%, 0.001%, 0.002%, 0.003%, 0.004%, 0.005%, 0.006%, 0.007%, or 0.008% Ca. In some embodiments, Ca is not present in the alloy (i.e., 0%). All expressed in wt. %.

In some embodiments, the heat-treatable alloy as described herein includes cadmium (Cd) in an amount of from 0% to 0.04% (e.g., from 0% to 0.01%, from 0% to 0.008%, or from 0% to 0.004%) based on the total weight of the alloy. For example, the alloy can include 0.001%, 0.002%, 0.003%, 0.004%, 0.005%, 0.006%, 0.007%, 0.008%, 0.009%, 0.010%, 0.011%, 0.012%, 0.013%, 0.014%, 0.015%, 0.016%, 0.017%, 0.018%, 0.019%, 0.020%, 0.021%, 0.022%, 0.023%, 0.024%, 0.025%, 0.026%, 0.027%, 0.028%, 0.029%, 0.030%, 0.031%, 0.032%, 0.033%, 0.034%, 0.035%, 0.036%, 0.037%, 0.038%, 0.039%, or 0.040% Cd. In some embodiments, Cd is not present in the alloy (i.e., 0%). All expressed in wt. %.

In some embodiments, the heat-treatable alloy as described herein includes lithium (Li) in an amount of from 0% to 0.003% (e.g., from 0% to 0.001%, from 0% to 0.0008%, or from 0% to 0.0003%) based on the total weight of the alloy. For example, the alloy can include 0.0001%, 0.0002%, 0.0003%, 0.0004%, 0.0005%, 0.0006%, 0.0007%, 0.0008%, 0.0009%, 0.0010%, 0.0011%, 0.0012%, 0.0013%, 0.0014%, 0.0015%, 0.0016%, 0.0017%, 0.0018%, 0.0019%, 0.0020%, 0.0021%, 0.0022%, 0.0023%, 0.0024%, 0.0025%, 0.0026%, 0.0027%, 0.0028%, 0.0029%, or 0.0030% Li. In some embodiments, Li is not present in the alloy (i.e., 0%). All expressed in wt. %.

In some embodiments, the heat-treatable alloy as described herein includes sodium (Na) in an amount of from 0% to 0.003% (e.g., from 0% to 0.001%, from 0% to 0.0008%, or from 0% to 0.0003%) based on the total weight of the alloy. For example, the alloy can include 0.0001%, 0.0002%, 0.0003%, 0.0004%, 0.0005%, 0.0006%, 0.0007%, 0.0008%, 0.0009%, 0.0010%, 0.0011%, 0.0012%, 0.0013%, 0.0014%, 0.0015%, 0.0016%, 0.0017%, 0.0018%, 0.0019%, 0.0020%, 0.0021%, 0.0022%, 0.0023%, 0.0024%, 0.0025%, 0.0026%, 0.0027%, 0.0028%, 0.0029%, or 0.0030% Na. In some embodiments, Na is not present in the alloy (i.e., 0%). All expressed in wt. %.

In some embodiments, the heat-treatable alloy as described herein includes zirconium (Zr) in an amount of from 0% to 0.2% (e.g., from 0.01% to 0.2% or from 0.05% to 0.1%) based on the total weight of the alloy. For example, the alloy can include 0.01%, 0.02%, 0.03%, 0.04%, 0.05%, 0.06%, 0.07%, 0.08%, 0.09%, 0.10%, 0.11%, 0.12%, 0.13%, 0.14%, 0.15%, 0.16%, 0.17%, 0.18%, 0.19%, or 0.20% Zr. In some embodiments, Zr is not present in the alloy (i.e., 0%). All expressed in wt. %.

In some embodiments, the heat-treatable alloy as described herein includes scandium (Sc) in an amount of from 0% to 0.2% (e.g., from 0.01% to 0.2% or from 0.05% to 0.1%) based on the total weight of the alloy. For example, the alloy can include 0.01%, 0.02%, 0.03%, 0.04%, 0.05%, 0.06%, 0.07%, 0.08%, 0.09%, 0.10%, 0.11%, 0.12%, 0.13%, 0.14%, 0.15%, 0.16%, 0.17%, 0.18%, 0.19%, or 0.20% Sc. In some embodiments, Sc is not present in the alloy (i.e., 0%). All expressed in wt. %.

In some embodiments, the heat-treatable alloy as described herein includes vanadium (V) in an amount of from 0% to 0.2% (e.g., from 0.01% to 0.2% or from 0.05% to 0.1%) based on the total weight of the alloy. For example, the alloy can include 0.01%, 0.02%, 0.03%, 0.04%, 0.05%, 0.06%, 0.07%, 0.08%, 0.09%, 0.10%, 0.11%, 0.12%, 0.13%, 0.14%, 0.15%, 0.16%, 0.17%, 0.18%, 0.19%, or 0.20% V. In some embodiments, V is not present in the alloy (i.e., 0%). All expressed in wt. %.

In various embodiments, sub-ranges of the ranges shown in the first embodiment are used to make the alloys of the present invention. In a second embodiment, the automotive aluminum sheet is a heat-treatable alloy of the following composition:

| Constituent | Range (wt. %) |
|---|---|
| Cu | 0.45-0.75 |
| Fe | 0.1-0.35 |
| Mg | 0.45-0.85 |
| Mn | 0.1-0.35 |
| Si | 0.45-0.65 |
| Ti | 0.05-0.15 |
| Zn | 0-0.1 |
| Cr | 0.02-0.18 |
| Pb | 0-0.007 |
| Be | 0-0.0005 |
| Ca | 0-0.004 |
| Cd | 0-0.01 |
| Li | 0-0.001 |
| Na | 0-0.001 |
| Zr | 0-0.2 |
| Sc | 0-0.2 |
| V | 0-0.2 |
| Trace element impurities | 0-0.1 |
| Aluminum | Remainder |

In a third embodiment, the automotive aluminum sheet is a heat-treatable alloy of the following composition:

| Constituent | Range (wt. %) |
|---|---|
| Cu | 0.45-0.65 |
| Fe | 0.1-0.3 |
| Mg | 0.5-0.8 |
| Mn | 0.15-0.35 |
| Si | 0.45-0.65 |
| Ti | 0.05-0.12 |
| Zn | 0-0.1 |
| Cr | 0.02-0.14 |
| Pb | 0-0.007 |
| Be | 0-0.0003 |
| Ca | 0-0.001 |
| Cd | 0-0.008 |
| Li | 0-0.0008 |
| Na | 0-0.0008 |
| Zr | 0-0.2 |
| Sc | 0-0.2 |
| V | 0-0.2 |
| Trace element impurities | 0-0.1 |
| Aluminum | Remainder |

In a fourth embodiment, the automotive aluminum sheet is a heat-treatable alloy, referred to as "x615" in this application, of the following composition:

| Constituent | Range (wt. %) | Nominal (wt. %) |
|---|---|---|
| Cu | 0.51-0.59 | 0.55 |
| Fe | 0.22-0.26 | 0.24 |
| Mg | 0.66-0.74 | 0.70 |
| Mn | 0.18-0.22 | 0.20 |
| Si | 0.57-0.63 | 0.60 |
| Ti | 0-0.08 | |

-continued

| Constituent | Range (wt. %) | Nominal (wt. %) |
|---|---|---|
| Zn | 0-0.1 | |
| Cr | 0.06-0.1 | 0.08 |
| Pb | 0-0.005 | |
| Be | 0-0.0001 | |
| Ca | 0-0.0008 | |
| Cd | 0-0.004 | |
| Li | 0-0.0003 | |
| Na | 0-0.0003 | |
| Zr | 0-0.2 | |
| Sc | 0-0.2 | |
| V | 0-0.2 | |
| Trace element impurities | 0-0.1 | |
| Aluminum | Remainder | Remainder |
| Free Si | 0-0.70 | 0.478 |
| $Mg_2Si$ (1.73) | 0-1.50 | 1.1046 |
| Excess Si | 0-0.10 | 0.0734 |
| $Mg_xSi$ (1.2) | 0-1.50 | 1.281 |
| Excess Si | −0.20-0 | −0.103 |

Excess silicon calculations as shown in the table above and in subsequent tables were made according to the method in U.S. Pat. No. 4,614,552, col. 4, lines 49-52. The excess Si in the third row is for the $Mg_2Si$ in the second row above. The excess Si in the fifth row is for the MgSi in the fourth row above.

For the heat treatable 6xxx alloys, the solute elements that contribute to the age hardened strength include Cu, Mg and Si. The table above is directed to the ability of the Mg and Si to combine to form "$Mg_2Si$".

Figure 9:
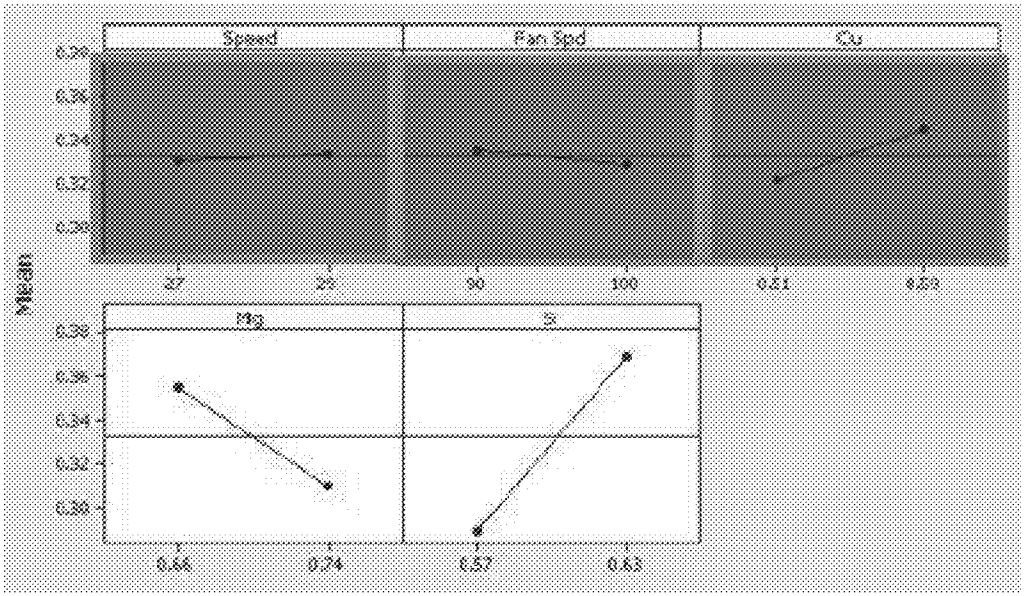
FIG. 9 is a schematic representation of a main effects plot for average r/t graph where the r/t ratio is the vertical axis and amount is the horizontal axis (more Mg—lower r/t; less Si—lower r/t). This effects plot is the outcome of an industrial trial of 32 ingots whereby the Cu, Mg and Si contents along with 2 line parameters were systematically examined via a DOE (Design of Experiment) trial. Details of this trial are summarized within the Examples and with accompanying figures.

The actual internal chemical composition tolerance limits and CASH processing conditions are capable of producing x615 material with mechanical properties and bendability properties within the desired specification limits. The evaluation verifies that we have a robust process window on the CASH line. Chemical composition variations have the largest impact on mechanical properties and bendability performance. Cu, Si, and Mg increase the T4 yield strength (YS), T4 ultimate tensile strength (UTS), and T82 YS. Cu influences the T4 strength values but the impact on bendability is small. Increasing Mg appears to give better bendability. The strongest single variable is Si: lower Si gives better bendability and lower difference between the T81 and T4 yield strengths, i.e., ΔYS (T81-T4) (see FIG. 9 and example).

In a fifth embodiment, the automotive aluminum sheet is a heat-treatable alloy of the following composition:

| Constituent | Range (wt. %) | Nominal (wt. %) |
|---|---|---|
| Cu | 0.51-0.59 | 0.55 |
| Fe | 0.22-0.26 | 0.24 |
| Mg | 0.66-0.74 | 0.70 |
| Mn | 0.18-0.22 | 0.20 |
| Si | 0.55-0.6 | 0.60 |
| Ti | 0-0.08 | |
| Zn | 0-0.1 | |
| Cr | 0.06-0.1 | 0.08 |
| Pb | 0-0.005 | |
| Be | 0-0.0001 | |
| Ca | 0-0.0008 | |
| Cd | 0-0.004 | |
| Li | 0-0.0003 | |
| Na | 0-0.0003 | |
| Zr | 0-0.2 | |
| Sc | 0-0.2 | |
| V | 0-0.2 | |
| Trace element impurities | 0-0.1 | |
| Aluminum | Remainder | Remainder |

-continued

| Constituent | Range (wt. %) | Nominal (wt. %) |
|---|---|---|
| Free Si | 0-0.70 | 0.478 |
| $Mg_2Si$ (1.73) | 0-1.50 | 1.1046 |
| Excess Si | 0-0.10 | 0.0734 |
| $Mg_xSi$ (1.2) | 0-1.50 | 1.281 |
| Excess Si | −0.20-0 | −0.103 |

In a sixth embodiment, the automotive aluminum sheet is a heat-treatable alloy of the following composition:

| Constituent | Range (wt. %) | Nominal (wt. %) |
|---|---|---|
| Cu | 0.50-0.54 | 0.52 |
| Fe | 0.22-0.26 | 0.24 |
| Mg | 0.71-0.79 | 0.75 |
| Mn | 0.18-0.22 | 0.20 |
| Si | 0.52-0.58 | 0.55 |
| Ti | 0-0.08 | |
| Zn | 0-0.05 | |
| Cr | 0.03-0.08 | 0.04 |
| Pb | 0-0.005 | |
| Be | 0-0.0001 | |
| Ca | 0-0.0008 | |
| Cd | 0-0.004 | |
| Li | 0-0.0003 | |
| Na | 0-0.0003 | |
| Zr | 0-0.2 | |
| Sc | 0-0.2 | |
| V | 0-0.2 | |
| Trace element impurities | 0-0.1 | |
| Aluminum | Remainder | Remainder |
| Free Si | 0-0.70 | 0.428 |
| $Mg_2Si$ (1.73) | 0-1.50 | 1.1835 |
| Excess Si | −0.01-0 | −0.0055 |
| $Mg_xSi$ (1.2) | 0-1.50 | 1.3725 |
| Excess Si | −0.30-0 | −0.1945 |

In a seventh embodiment, the automotive aluminum sheet is a heat-treatable alloy of the following composition:

| Constituent | Range (wt. %) | Nominal (wt. %) |
|---|---|---|
| Cu | 0.50-0.54 | 0.52 |
| Fe | 0.22-0.26 | 0.24 |
| Mg | 0.71-0.79 | 0.75 |
| Mn | 0.18-0.22 | 0.20 |
| Si | 0.52-0.58 | 0.55 |
| Ti | 0-0.08 | |
| Zn | 0-0.05 | |
| Cr | 0.10-0.14 | 0.12 |
| Pb | 0-0.005 | |
| Be | 0-0.0001 | |
| Ca | 0-0.0008 | |
| Cd | 0-0.004 | |
| Li | 0-0.0003 | |
| Na | 0-0.0003 | |
| Zr | 0-0.2 | |
| Sc | 0-0.2 | |
| V | 0-0.2 | |
| Trace element impurities | 0-0.1 | |
| Aluminum | Remainder | Remainder |
| Free Si | 0-0.70 | 0.428 |
| $Mg_2Si$ (1.73) | 0-1.50 | 1.1835 |
| Excess Si | −0.01-0 | −0.0055 |
| $Mg_xSi$ (1.2) | 0-1.50 | 1.3725 |
| Excess Si | −0.30-0 | −0.1945 |

In an eighth embodiment, the automotive aluminum sheet is a heat-treatable alloy of the following composition:

| Constituent | Range (wt. %) | Nominal (wt. %) |
|---|---|---|
| Cu | 0.50-0.54 | 0.52 |
| Fe | 0.22-0.26 | 0.24 |
| Mg | 0.71-0.79 | 0.75 |
| Mn | 0.28-0.32 | 0.30 |
| Si | 0.52-0.58 | 0.55 |
| Ti | 0-0.08 | |
| Zn | 0-0.05 | |
| Cr | 0.03-0.08 | 0.04 |
| Pb | 0-0.005 | |
| Be | 0-0.0001 | |
| Ca | 0-0.0008 | |
| Cd | 0-0.004 | |
| Li | 0-0.0003 | |
| Na | 0-0.0003 | |
| Zr | 0-0.2 | |
| Sc | 0-0.2 | |
| V | 0-0.2 | |
| Trace element impurities | 0-0.1 | |
| Aluminum | Remainder | Remainder |
| Free Si | 0-0.70 | 0.403 |
| $Mg_2Si$ (1.73) | 0-1.50 | 1.1835 |
| Excess Si | −0.05-0 | −0.0305 |
| $Mg_xSi$ (1.2) | 0-1.50 | 1.3725 |
| Excess Si | −0.30-0 | −0.2195 |

In a ninth embodiment, the automotive aluminum sheet is a heat-treatable alloy of the following composition:

| Constituent | Range (wt. %) | Nominal (wt. %) |
|---|---|---|
| Cu | 0.50-0.54 | 0.52 |
| Fe | 0.22-0.26 | 0.24 |
| Mg | 0.71-0.79 | 0.75 |
| Mn | 0.28-0.32 | 0.30 |
| Si | 0.52-0.58 | 0.55 |
| Ti | 0-0.08 | |
| Zn | 0-0.05 | |
| Cr | 0.10-0.14 | 0.12 |
| Pb | 0-0.005 | |
| Be | 0-0.0001 | |
| Ca | 0-0.0008 | |
| Cd | 0-0.004 | |
| Li | 0-0.0003 | |
| Na | 0-0.0003 | |
| Zr | 0-0.2 | |
| Sc | 0-0.2 | |
| V | 0-0.2 | |
| Trace element impurities | 0-0.1 | |
| Aluminum | Remainder | Remainder |
| Free Si | 0-0.70 | 0.403 |
| $Mg_2Si$ (1.73) | 0-1.50 | 1.1835 |
| Excess Si | −0.05-0 | −0.0305 |
| $Mg_xSi$ (1.2) | 0-1.50 | 1.3725 |
| Excess Si | −0.30-0 | −0.2195 |

In a tenth embodiment, the automotive aluminum sheet is a heat-treatable alloy of the following composition:

| Constituent | Range (wt. %) | Nominal (wt. %) |
|---|---|---|
| Cu | 0.68-0.72 | 0.70 |
| Fe | 0.18-0.22 | 0.20 |
| Mg | 0.66-0.74 | 0.70 |
| Mn | 0.23-0.27 | 0.25 |
| Si | 0.57-0.63 | 0.60 |
| Ti | 0-0.08 | |
| Zn | 0-0.05 | |
| Cr | 0.06-0.10 | 0.08 |
| Pb | 0-0.005 | |
| Be | 0-0.0001 | |
| Ca | 0-0.0008 | |
| Cd | 0-0.004 | |
| Li | 0-0.0003 | |

-continued

| Constituent | Range (wt. %) | Nominal (wt. %) |
|---|---|---|
| Na | 0-0.0003 | |
| Zr | 0-0.2 | |
| Sc | 0-0.2 | |
| V | 0-0.2 | |
| Trace element impurities | 0-0.1 | |
| Aluminum | Remainder | Remainder |
| Free Si | 0-0.70 | 0.4775 |
| $Mg_2Si$ (1.73) | 0-1.50 | 1.1046 |
| Excess Si | 0-0.10 | 0.0729 |
| $Mg_xSi$ (1.2) | 0-1.50 | 1.281 |
| Excess Si | −0.30-0 | −0.1035 |

Service Strength:

The aluminum sheet of the present invention may have a service strength (strength on the vehicle) of at least about 250 MPa. In some embodiments, the service strength is at least about 260 MPa, at least about 270 MPa, at least about 280 MPa, or at least about 290 MPa. Preferably, the service strength is about 290 MPa. The aluminum sheet of the present invention encompasses any service strength that has sufficient ductility or toughness to meet an r/t bendability of 0.8 or less. Preferably, the r/t bendability is 0.4 or less.

The mechanical properties of the aluminum sheet are controlled by various aging conditions depending on the desired use. In some embodiments, the sheets described herein can be delivered to customers in a T4 temper, a T6 temper, a T8 temper, a T9 temper, a T81 temper, or a T82 temper, for example. T4 sheets, which refer to sheets that are solution heat treated and naturally aged, can be delivered to customers. These T4 sheets can optionally be subjected to additional aging treatment(s) to meet strength requirements upon receipt by customers. For example, sheets can be delivered in other tempers, such as T6, T8, T81, T82, and T9 tempers, by subjecting the T4 sheet to the appropriate solution heat treatment and/or aging treatment as known to those of skill in the art.

In some embodiments, the sheets can be pre-strained at 2% and heated to 185° C. for 20 minutes to achieve a T81 temper. Such T81 temper sheets can display, for example, a yield strength of 250 MPa.

Dispersoid Microstructure Control:

The alloys described herein have dispersoids that form during the homogenization treatment. The average size of the dispersoids can be from about 0.008 $\mu m^2$ to about 2 $\mu m^2$. For example, the average size of the dispersoids can be about 0.008 $\mu m^2$, about 0.009 $\mu m^2$ about 0.01 $\mu m^2$, about 0.011 $\mu m^2$, about 0.012 $\mu m^2$, about 0.013 $\mu m^2$, about 0.014 $\mu m^2$ about 0.015 $\mu m^2$, about 0.016 $\mu m^2$, about 0.017 $\mu m^2$, about 0.018 $\mu m^2$, about 0.019 $\mu m^2$ about 0.02 $\mu m^2$, about 0.05 $\mu m^2$, about 0.10 $\mu m^2$, about 0.20 $\mu m^2$, about 0.30 $\mu m^2$, about 0.40 $\mu m^2$, about 0.50 $\mu m^2$, about 0.60 $\mu m^2$, about 0.70 $\mu m^2$, about 0.80 $\mu m^2$, about 0.90 $\mu m^2$, about 1 $\mu m^2$, about 1.1 $\mu m^2$, about 1.2 $\mu m^2$, about 1.3 $\mu m^2$, about 1.4 $\mu m^2$, about 1.5 $\mu m^2$, about 1.6 $\mu m^2$, about 1.7 $\mu m^2$, about 1.8 $\mu m^2$, about 1.9 $\mu m^2$, or about 2 $\mu m^2$.

As described above, the alloys described herein are designed to contain a sufficient number of dispersoids to reduce strain localization and to uniformly distribute the deformation. The number of dispersoid particles per 200 $\mu m^2$ is preferably greater than about 500 particles as measured by scanning electron microscopy (SEM). For example, the number of particles per 200 $\mu m^2$ can be greater than about 600 particles, greater than about 700 particles, greater than about 800 particles, greater than about 900 particles, greater than about 1000 particles, greater than about 1100 particles, greater than about 1200 particles, greater than about 1300 particles, greater than about 1400 particles, greater than about 1500 particles, greater than about 1600 particles, greater than about 1700 particles, greater than about 1800 particles, greater than about 1900 particles, greater than about 2000 particles, greater than about 2100 particles, greater than about 2200 particles, greater than about 2300 particles, or greater than about 2400 particles.

The area percent of the dispersoids can range from about 0.002% to 0.01% of the alloy. For example, the area percent of the dispersoids in the alloys can be about 0.002%, about 0.003%, about 0.004%, about 0.005%, about 0.006%, about 0.007%, about 0.008%, about 0.009%, or about 0.010%.

The area fraction of the dispersoids can range from about 0.05 to about 0.15. For example, the area fraction of the dispersoids can be from about 0.06 to about 0.14, from about 0.07 to about 0.13, or from 0.08 to about 0.12.

As described further in Example 1, the homogenization conditions impact the average size, number density, area percent, and area fraction of the dispersoids.

Process:

The alloys described herein can be cast into ingots using a Direct Chill (DC) process. The DC casting process is performed according to standards commonly used in the aluminum industry as known to one of skill in the art. The cast ingot can then be subjected to further processing steps. In some embodiments, the processing steps include, but are not limited to, a homogenization step, a hot rolling step, a cold rolling step, a solution heat treatment step, and optionally an aging treatment.

The homogenization practice is selected to first have a heating rate that promotes the formation of a fine dispersoid content. The dispersoids, Cr and/or Mn, precipitate (ppt) out during the heating portion of the homogenization cycle. The peak temperatures and times of the homogenization cycle are selected to provide for a very complete homogenization of the soluble phases. In some embodiments of the homogenization step, an ingot prepared from an alloy composition as described herein is heated to attain a peak metal temperature of at least about 500° C. (e.g., at least 530° C., at least 540° C., at least 550° C., at least 560° C., or at least 570° C.). For example, the ingot can be heated to a temperature of from about 505° C. to about 580° C., from about 510° C. to about 575° C., from about 515° C. to about 570° C., from about 520° C. to about 565° C., from about 525° C. to about 560° C., from about 530° C. to about 555° C., or from about 535° C. to about 560° C. The heating rate to the peak metal temperature can be 100° C./hour or less, 75° C./hour or less, or 50° C./hour or less. Optionally, a combination of heating rates can be used. For example, the ingot can be heated to a first temperature of from about 200° C. to about 300° C. (e.g., about 210° C., 220° C., 230° C., 240° C., 250° C., 260° C., 270° C., 280° C., 290° C., or 300° C.) at a rate of about 100° C./hour or less (e.g., 90° C./hour or less, 80° C./hour or less, or 70° C./hour or less). The heating rate can then be decreased until a second temperature higher than the first temperature is reached. The second temperature can be, for example, at least about 475° C. (e.g., at least 480° C., at least 490° C., or at least 500° C.). The heating rate from the first temperature to the second temperature can be at a rate of about 80° C./hour or less (e.g., 75° C./hour or less, 70° C./hour or less, 65° C./hour or less, 60° C./hour or less, 55° C./hour or less, or 50° C./hour or less). The temperature can then be increased to the peak metal temperature, as described above, by heating at a rate of about 60° C./hour or less (e.g., 55° C./hour or less, 50° C./hour or less, 45° C./hour or less, or 40° C./hour or less). The ingot is then allowed to soak (i.e., held at the indicated temperature) for a period of time. In some embodiments, the ingot is allowed to soak for up to 15 hours (e.g., from 30 minutes to 15 hours, inclusively). For example, the ingot can be soaked at the temperature of at least 500° C. for 30 minutes, 1 hour, 2 hours, 3 hours, 4 hours, 5 hours, 6 hours, 7 hours, 8 hours, 9 hours, 10 hours, 11 hours, 12 hours, 13 hours, 14 hours, or 15 hours.

In some embodiments, the homogenization step described herein can be a two-stage homogenization process. In these embodiments, the homogenization process can include the above-described heating and soaking steps, which can be referred to as the first stage, and can further include a second stage. In the second stage of the homogenization process, the ingot temperature is changed to a temperature higher or lower than the temperature used for the first stage of the homogenization process. For example, the ingot temperature can be decreased to a temperature lower than the temperature used for the first stage of the homogenization process. In these embodiments of the second stage of the homogenization process, the ingot temperature can be decreased to a temperature of at least 5° C. lower than the temperature used for the first stage homogenization process (e.g., at least 10° C. lower, at least 15° C. lower, or at least 20° C. lower). The ingot is then allowed to soak for a period of time during the second stage. In some embodiments, the ingot is allowed to soak for up to 5 hours (e.g., from 30 minutes to 5 hours, inclusively). For example, the ingot can be soaked at the temperature of at least 455° C. for 30 minutes, 1 hour, 2 hours, 3 hours, 4 hours, or 5 hours. Following homogenization, the ingot can be allowed to cool to room temperature in the air.

At the end of the homogenization step, a hot rolling step is performed. The hot rolling conditions are selected to retain the previously produced dispersoid content and to finish the hot rolling with a minimum amount of precipitate of the soluble hardening phases out of solution, and below the recrystallization temperature. The hot rolling step can include a hot reversing mill operation and/or a hot tandem mill operation. The hot rolling step can be performed at a temperature ranging from about 250° C. to 530° C. (e.g., from about 300° C. to about 520° C., from about 325° C. to about 500° C. or from about 350° C. to about 450° C.). In the hot rolling step, the ingot can be hot rolled to a 10 mm thick gauge or less (e.g., from 2 mm to 8 mm thick gauge). For example, the ingot can be hot rolled to a 9 mm thick gauge or less, 8 mm thick gauge or less, 7 mm thick gauge or less, 6 mm thick gauge or less, 5 mm thick gauge or less, 4 mm thick gauge or less, 3 mm thick gauge or less, 2 mm thick gauge or less, or 1 mm thick gauge or less.

Following the hot rolling step, the rolled hot bands can be cold rolled to a sheet having a final gauge thickness of from 1 mm to 4 mm. For example, the rolled hot bands can be cold rolled to a sheet having a final gauge thickness of 4 mm, 3 mm, 2 mm, or 1 mm. The cold rolling can be performed to result in a sheet having a final gauge thickness that represents an overall gauge reduction by 20%, 50%, 75%, or more than 75% using techniques known to one of ordinary skill in the art.

The cold rolled sheet can then undergo a solution heat treatment step. The solution heat treatment step can include heating the sheet from room temperature to a temperature of from about 475° C. to about 575° C. (e.g., from about 480° C. to about 570° C., from about 485° C. to about 565° C., from about 490° C. to about 560° C., from about 495° C. to about 555° C., from about 500° C. to about 550° C., from about 505° C. to about 545° C., from about 510° C. to about 540° C., or from about 515° C. to about 535° C.). The sheet can soak at the temperature for a period of time. In some embodiments, the sheet is allowed to soak for up to 60 seconds (e.g., from 0 seconds to 60 seconds, inclusively). For example, the sheet can be soaked at the temperature of from about 500° C. to about 550° C. for 5 seconds, 10 seconds, 15 seconds, 20 seconds, 25 seconds, 30 seconds, 35 seconds, 40 seconds, 45 seconds, 50 seconds, 55 seconds, or 60 seconds. The degree of completeness of the solution heat treatment is critical. The solution heat treatment must be sufficient to get the soluble elements into solution to reach the target strengths during the artificial aging practice, but not excessively so, since this will over shoot the strength targets, with the rapid decrease in toughness.

The composition must be carefully matched up to the solution heat treatment conditions and artificial aging practice. In some embodiments, the peak metal temperature and soak duration (seconds above 510° C.) are selected to produce a T82 strength (30 minutes at 225° C.) not to exceed 300 MPa YS. The material can be slightly under solution heat treated, which means that most, but not all soluble phases are in solid solution, with a peak metal temperature ranging from about 500-550° C.

The sheet can then be cooled to a temperature of from about 25° C. to about 50° C. in a quenching step. In the quenching step, the sheets are rapidly quenched with a liquid (e.g., water) and/or gas. The quench rates can be from 100° C./sec to 450° C./sec, as measured over the temp range of 450° C. to 250° C. The highest possible quench rates are preferred. The quench rate from the solution heat treatment temperature can be above 300° C./sec, for most gauges, over the temperature range from 480° C. to 250° C.

The quench path is selected to produce the metallurgical requirement of not precipitating on the grain boundaries during the quench, but without the need for significant stretch to correct for the shape. These sheet blanks are formed prior to artificial aging and hence must be flat with excellent forming properties. This would not be achieved if large strains are required to correct the shape produced by the rapid quench. The material also has reasonably stable room temperature properties without rapid natural age hardening. In some embodiments, the Cu content is at the lowest possible value to minimize any corrosion potential and be suitable for automotive paint systems, but high enough to achieve the target strength and toughness properties. In some embodiments, Cu is 0.4% at a minimum level.

The sheets described herein can also be produced from the alloys by using a continuous casting method, as known to those of skill in the art.

The alloys and methods described herein can be used in automotive and/or transportation applications, including motor vehicle, aircraft, and railway applications. In some embodiments, the alloys and methods can be used to prepare motor vehicle body part products.

The following examples will serve to further illustrate the present invention without, at the same time, however, constituting any limitation thereof. On the contrary, it is to be clearly understood that resort may be had to various embodiments, modifications and equivalents thereof which, after reading the description herein, may suggest themselves to those skilled in the art without departing from the spirit of the invention. During the studies described in the following examples, conventional procedures were followed, unless otherwise stated. Some of the procedures are described below for illustrative purposes.

Example 1

Determine Impact of Homogenization Practice on Distribution of Dispersoids of as-Homogenized Structure.

Peak metal temperatures (PMTs) of 530° C., 550° C. and 570° C. were examined at soak times of 4 hours, 8 hours, and 12 hours for x615 alloy ingots. Heating rates are shown in FIG. 1. A two-step homogenization was also analyzed, which involved heating the ingots to 560° C. for six hours and then decreasing the temperature to 540° C. and allowing the ingots to soak at this temperature for two hours.

Figure 2:
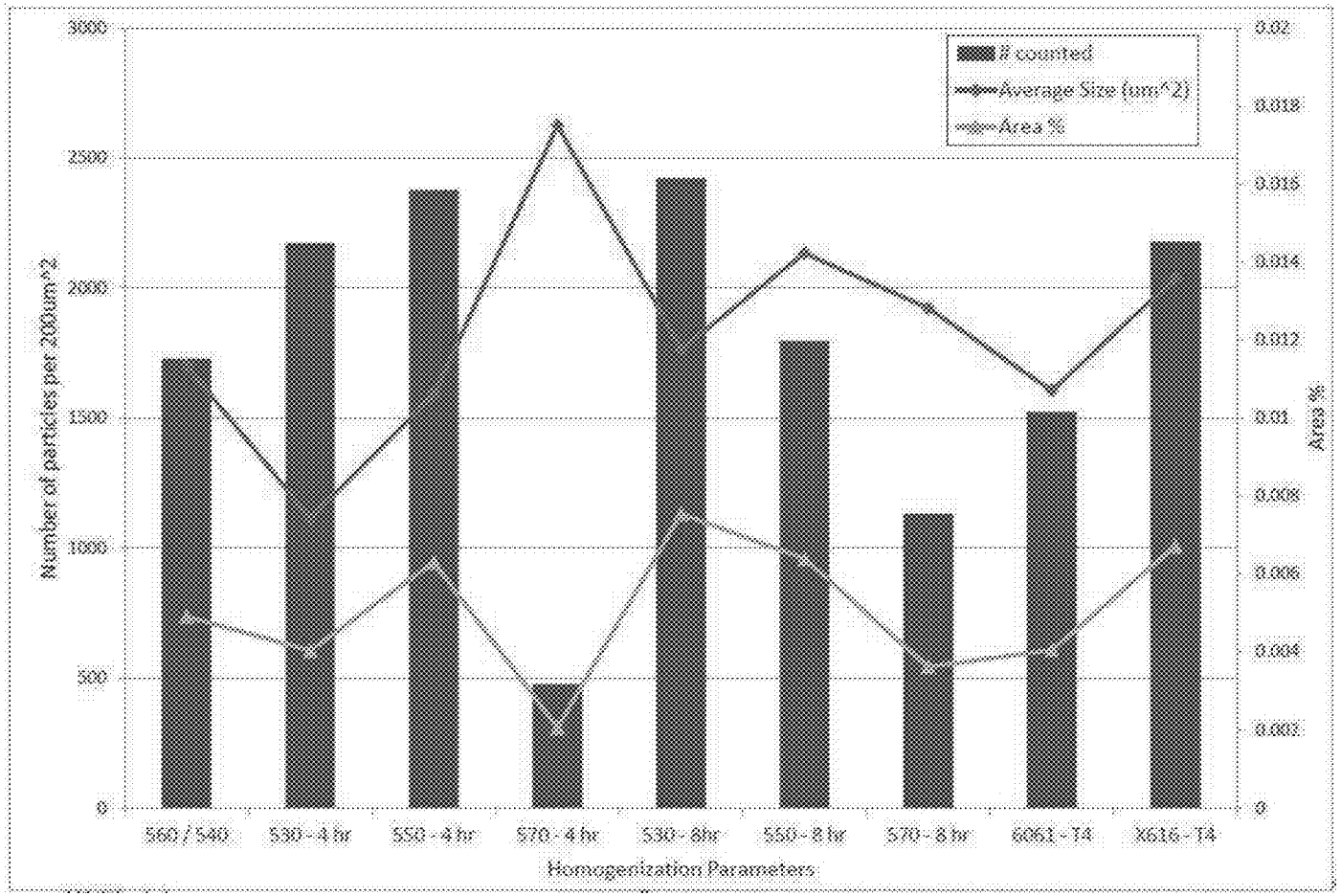
FIG. 2 is a graph depicting the number density, percent area, and average size of dispersoids produced by different homogenization practices.

For the 8 hour soak, the number density of dispersoids decreased with increasing temperature. See FIG. 2. Specifically, a temperature of 530° C. peak metal temperature (PMT) gave the highest number density of dispersoids. See FIG. 2. Not to be bound by theory, such effect may be due to coarsening. No $Mg_2Si$ was found during scanning transmission electron microscopy (STEM) investigation.

Figure 3:
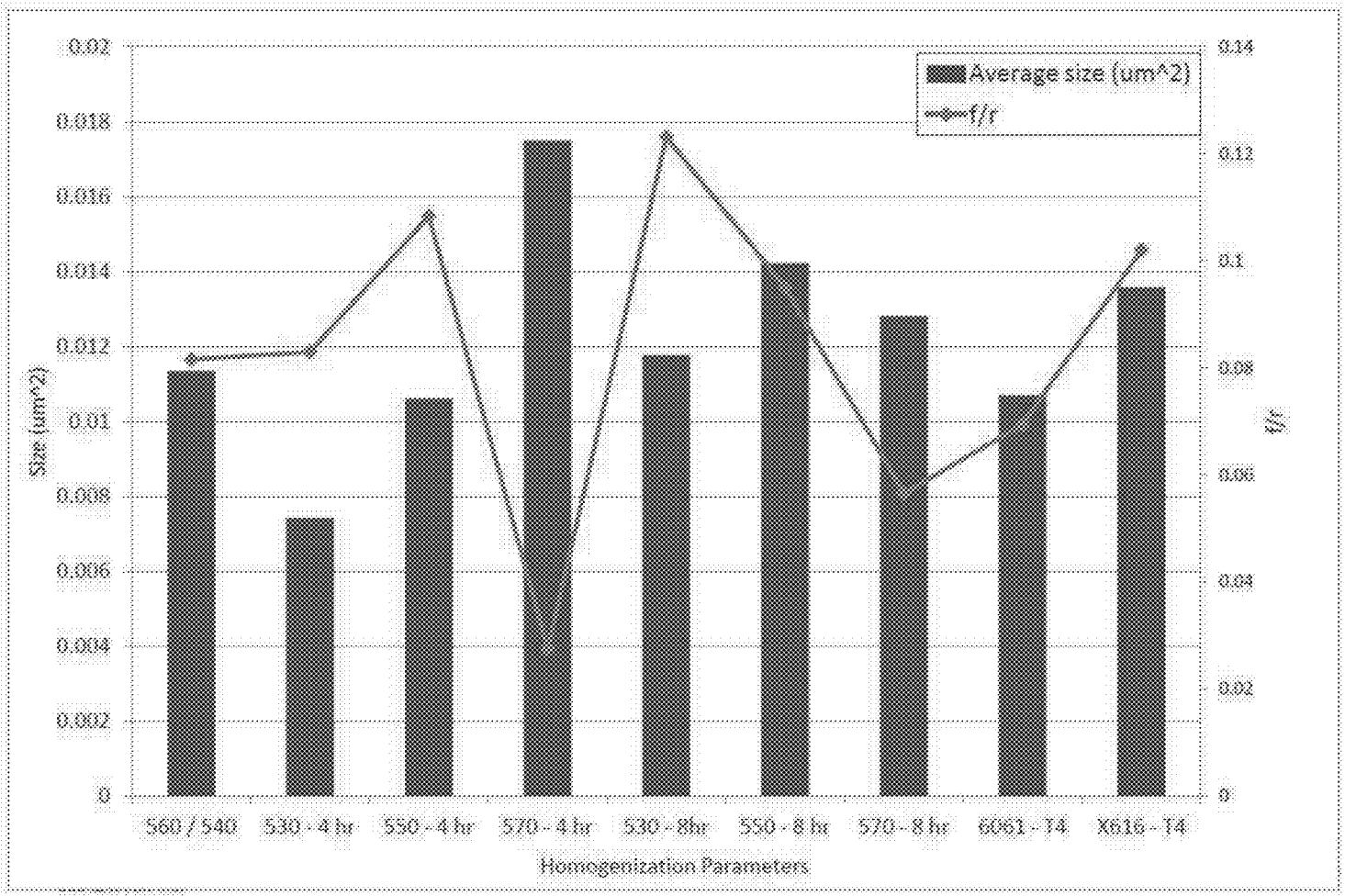
FIG. 3 is a graph depicting the average size and area fraction divided by radius (f/r) of dispersoids produced by different homogenization practices.

Both 530 and 550° C. PMTs gave a similar number density of dispersoids as the two-step practice (labeled as "560/540" in FIG. 3). See FIG. 3. The smallest average size was achieved with a 530° C. PMT and 4 hour soak, while the highest area fraction was achieved with 530° C. PMT and 8 hour soak (slightly enlarged dispersoids as well as a higher number density). See FIG. 3.

Figure 4:
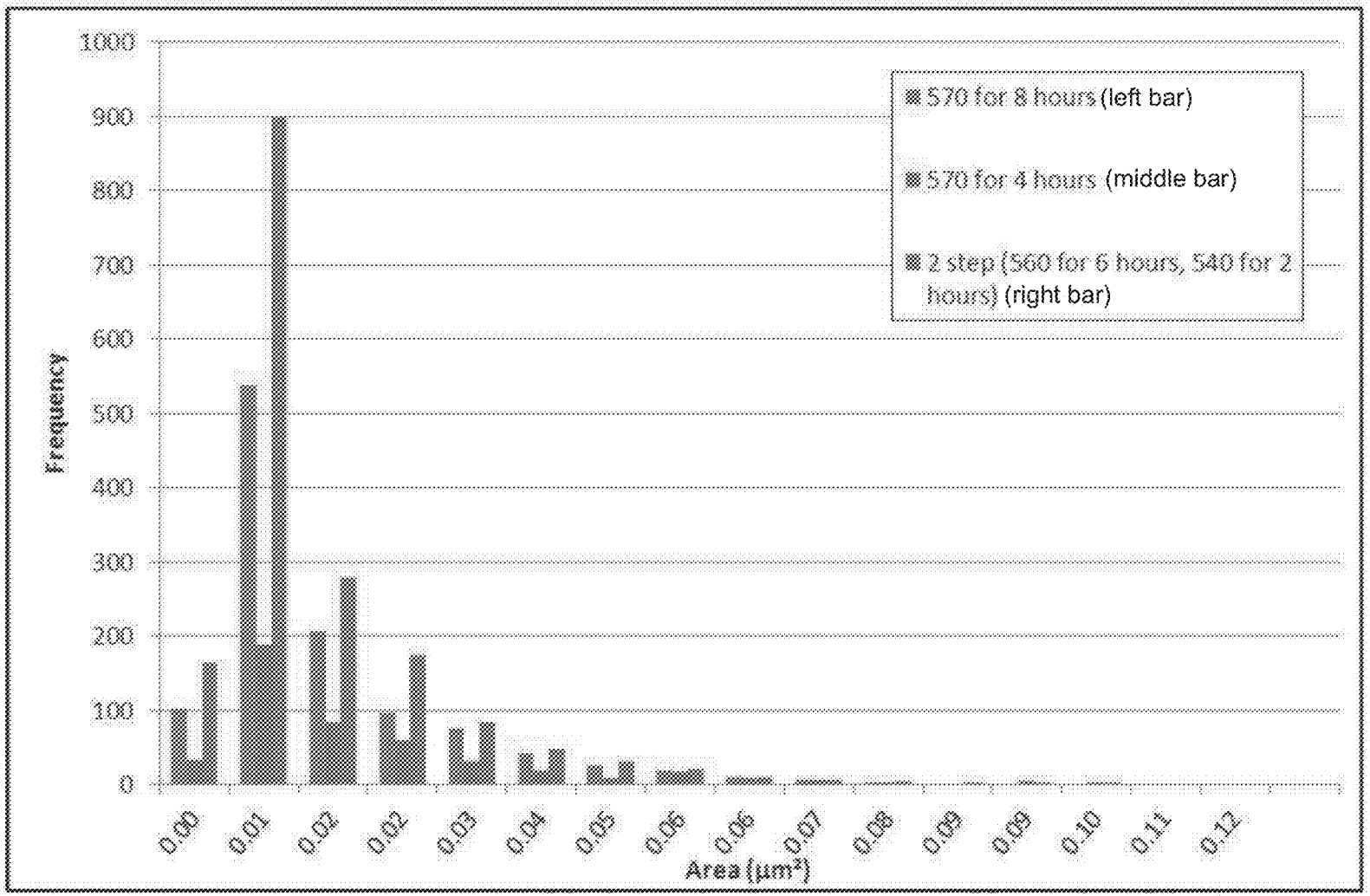
FIG. 4 is a graph showing the frequency and area of dispersoids produced by homogenization at 570° C. for 8 hours (left histogram bar in each set), at 570° C. for 4 hours (middle histogram bar in each set), and by a two-step practice of 560° C. for 6 hours and then at 540° C. for 2 hours (right histogram bar in each set).
Figure 5:
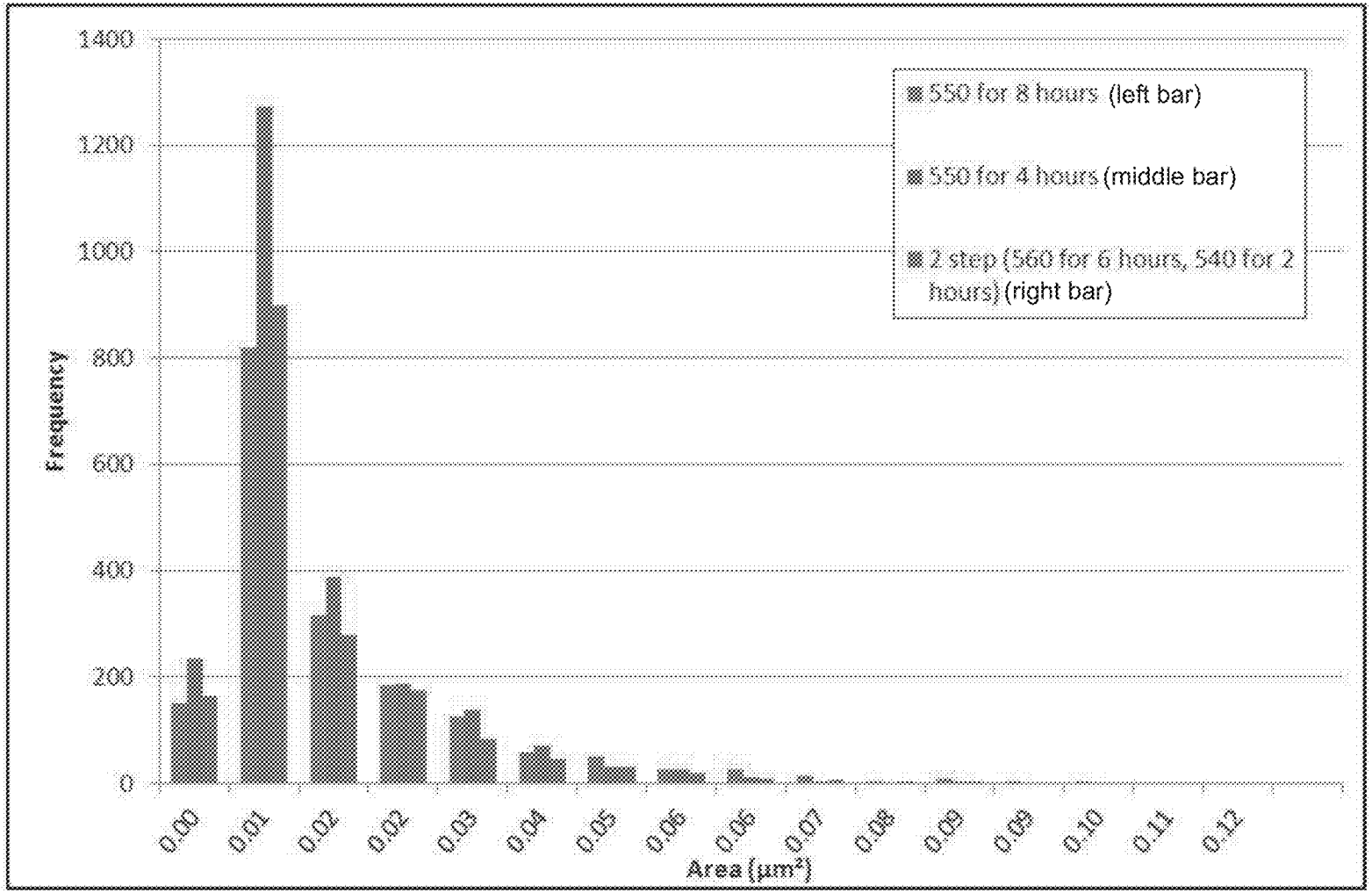
FIG. 5 is a graph showing the frequency and area of dispersoids produced by homogenization at 550° C. for 8 hours (left histogram bar in each set), at 550° C. for 4 hours (middle histogram bar in each set), and by a two-step practice of 560° C. for 6 hours and then at 540° C. for 2 hours (right histogram bar in each set).
Figure 6:
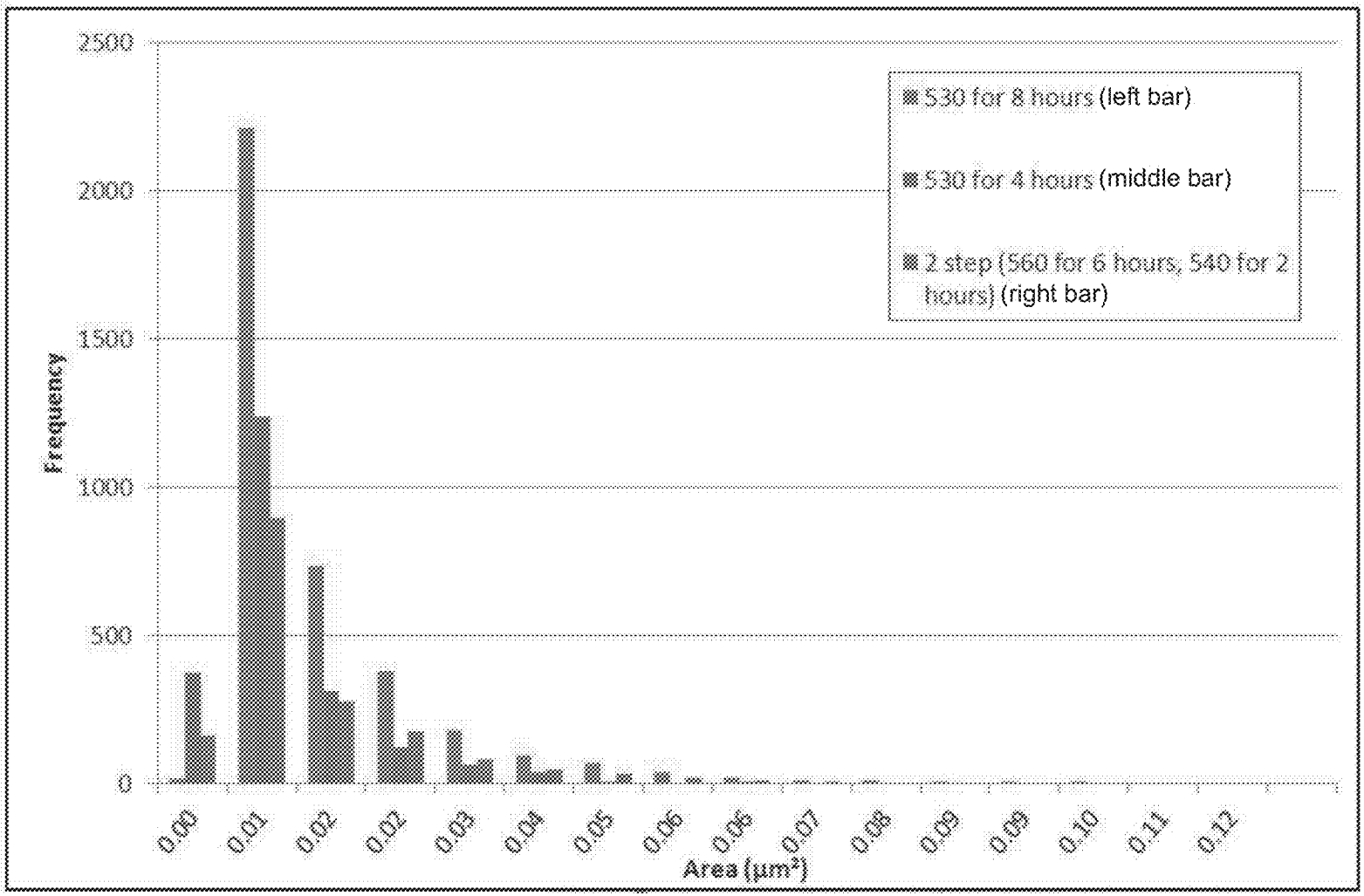
FIG. 6 is a graph showing the frequency and area of dispersoids produced by homogenization at 530° C. for 8 hours (left histogram bar in each set), at 530° C. for 4 hours (middle histogram bar in each set), and by a two-step practice of 560° C. for 6 hours and then at 540° C. for 2 hours (right histogram bar in each set).
Figure 7A:
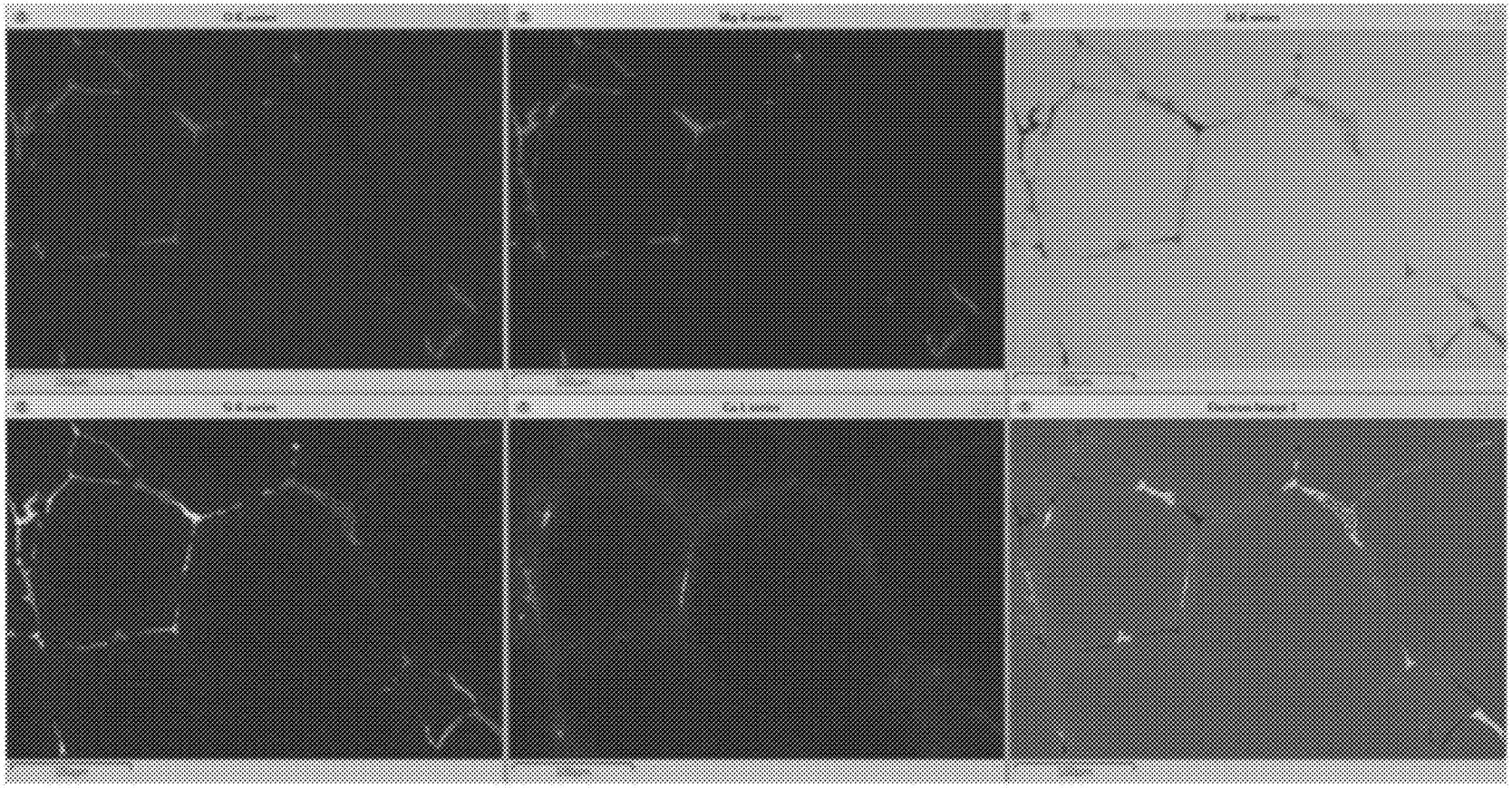
FIG. 7A is a compositional map of the ingots as cast.
Figure 7B:
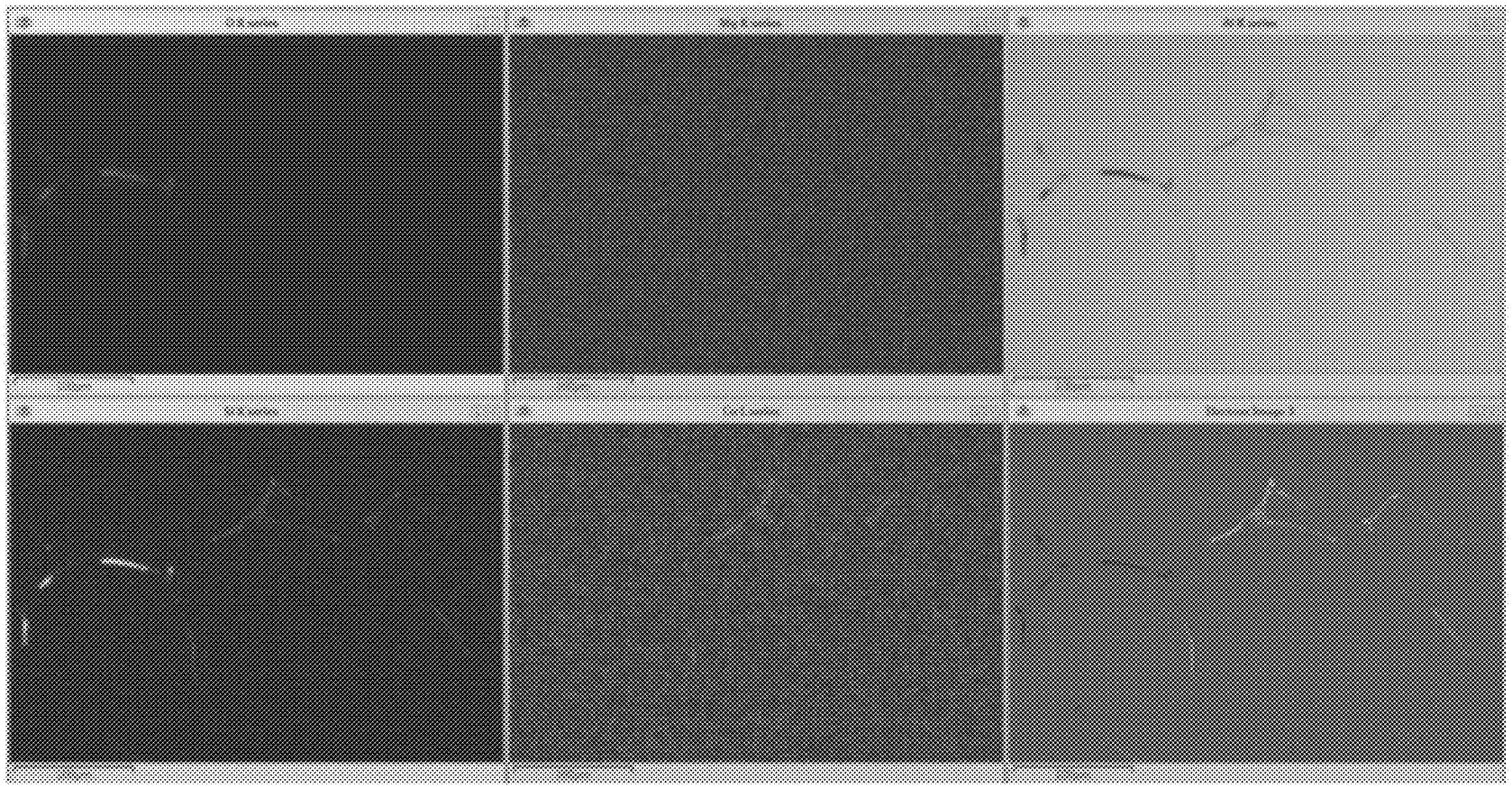
FIG. 7B is a compositional map of the ingots after a homogenization step at 530° C. for 4 hours.
Figure 7C:
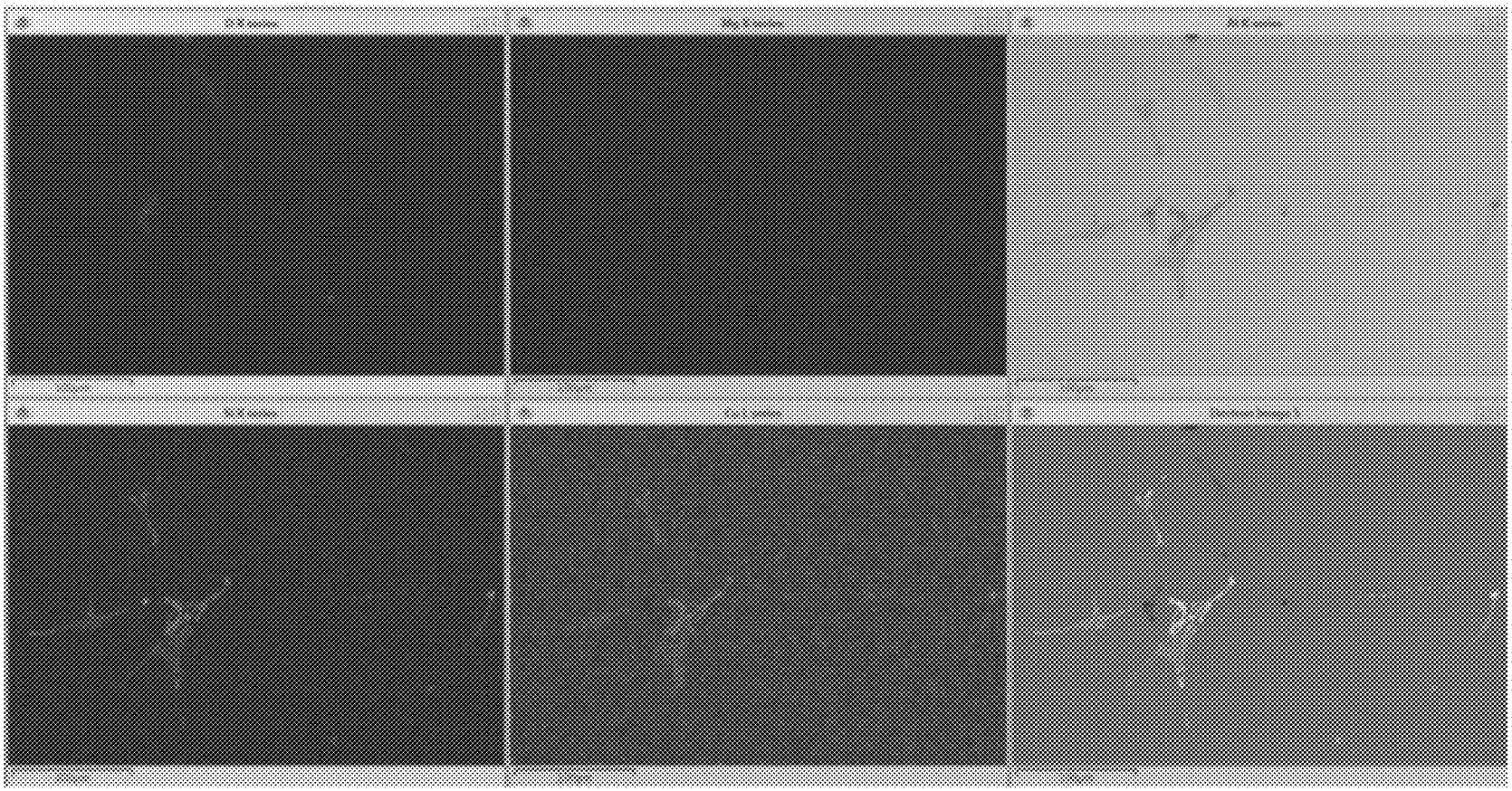
FIG. 7C is a compositional map of the ingots after a homogenization step at 530° C. for 8 hours.

The two-step process was more effective than any of the 570° C. PMT conditions. See FIG. 4. The two-step process was similar to the 550° C. PMT conditions. See FIG. 5. A PMT of 530° C. (at both soak times) showed favorable conditions over the two-step process. See FIG. 6. Compositional maps showed that 530° C. is an effective temperature to eliminate micro segregation, and metallography did not reveal any undissolved $Mg_2Si$. See FIGS. 7A, 7B, and 7C. For the ingots as cast, there was significant overlap between Si and Mg, which indicates precipitated $Mg_2Si$. See FIG. 7A. After homogenization at 530° C. for four hours, some Si was present (see FIG. 7B, lower left picture); however, Mg was not present where $Mg_2Si$ would be expected (see FIG. 7B, upper middle picture). After homogenization at 530° C. for eight hours, some Si was present in the intermetallic areas, as was Cu (see FIG. 7C, lower left picture and lower middle picture).

Example 2

In this example, alloy x615 is contrasted with alloy x616. Alloy x615 is a composition as described above. Alloy x616 is a heat-treatable alloy having the following composition:

| Constituent | Range (wt. %) | Nominal (wt. %) |
|---|---|---|
| Cu | 0.50-0.60 | 0.55 |
| Fe | 0.17-0.23 | 0.20 |
| Mg | 0.56-0.64 | 0.60 |
| Mn | 0.10-0.15 | 0.12 |
| Si | 0.80-0.90 | 0.85 |
| Ti | 0-0.08 | 0.2 |
| Zn | 0-0.05 | 0 |
| Cr | 0-0.2 | 0 |
| Pb | 0-0.005 | 0 |
| Be | 0-0.0001 | 0 |
| Ca | 0-0.0008 | 0 |
| Cd | 0-0.004 | 0 |
| Li | 0-0.0003 | 0 |
| Na | 0-0.0003 | 0 |
| Zr | 0-0.2 | 0 |
| Sc | 0-0.2 | 0 |
| V | 0-0.2 | 0 |
| Trace element impurities | 0-0.1 | |
| Aluminum | Remainder | Remainder |
| Free Si | | 0.76 |
| $Mg_2Si$ (1.73) | | 0.947 |
| Excess Si | | 0.413 |
| $Mg_xSi$ (1.2) | | 1.1 |
| Excess Si | | 0.26 |

Figure 8:
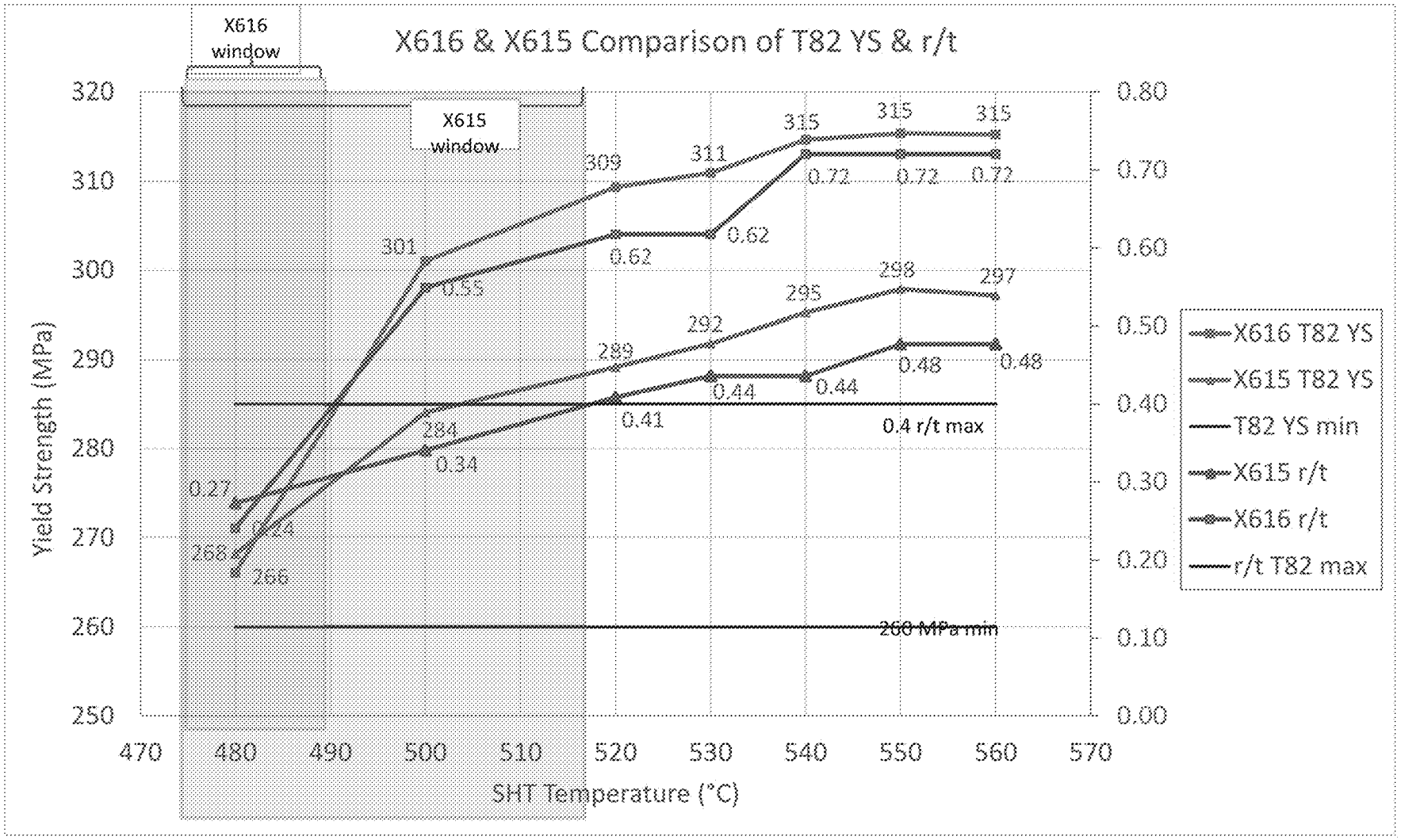
FIG. 8 is a schematic representation of yield strength (MPa) and r/t ratio of alloys x615 and x616 in T82 temper at various solution heat treatment (SHT) temperatures. x615 has a wider SHT temperature range than x616 to obtain r/t values below 0.4. The T82 yield strength minimum and r/t ration maximum values are also shown.

Cold rolled material was made using the steps described herein. This material was solution heat treated using laboratory equipment in a controlled experiment, whereby the PMT was varied and all samples were rapidly quenched. The results of these experiments are shown in FIG. 8. Alloy x615 exhibits a better a combination of strength and bendability and is capable of producing these beneficial properties over a broader range of PMTs. Due to heating rate differences between the plant and lab SHT material, equivalent material properties occur at different PMTs, but the combined strength and r/t behavior is similar.

Example 3

To more clearly define the influence of the Si, Mg and Cu content on the alloy properties, a Design of Experiment (DOE) was conducted using commercial ingots, producing a 3 mm final sheet product for testing and evaluation. Additionally two line parameters, namely the line speed and the fan speed setting, were simultaneously examined. These line parameters influence the peak metal temperature (PMT) that the material experiences during the continuous solution heat treatment (SHT). Specifically, the overall DOE explored Si in the range from 0.57-0.63, Mg from 0.66-0.74, and Cu from 0.51-0.59. The line speeds and fans combined produced a PMT ranging from 524° C. to 542° C. Within the DOE, all compositions and line parameters were capable of meeting the T82 strength target of exceeding 260 MPa, with the strength range of 270-308 MPa being produced. Most combinations of composition and line speed produced an r/t less than 0.4, many are less than 0.35, but 5 coils were identified with an r/t ratio above 0.4. It is particularly noteworthy that all coils with r/t values >0.4 were at the max Si limit explored in this DOE, albeit a slightly higher Mg content can somewhat ameliorate this negative influence as detailed in FIG. 9. The conclusion is that high excess Si alloys should be avoided and have a particularly strong influence on the ductility as measured by the r/t.

Example 4

Maximum Shear Strength of x615 and x616

Tests were done according to ASTM Designation B831-11: Shear Testing of Thin Aluminum Alloy Products. Gauges covered in this standard are 6.35 mm in gauge or less. Higher gauges need to be machined down to 6.35 mm. There is no minimum gauge but low gauges will buckle depending on strength. Alloy x615 was tested at a gauge of 3.534 mm in T4, T81 and T82 temper. Alloy x616 was tested at a gauge of 3.571 mm in T4, T81 and T82 temper.

Sample Preparation

Samples were Electro Discharge Machined by EDM Technologies, Woodstock, Ga. Alignment of 1-4 in FIG. 10 as well as cut finish is important hence the choice of EDM as cutting method. Clevace grips were also machined to promote alignment and ease of sample mounting without damage. All samples were tested with the rolling direction running tangential to the length of the sample.

Test Methodology—Test Procedure

Figure 10:
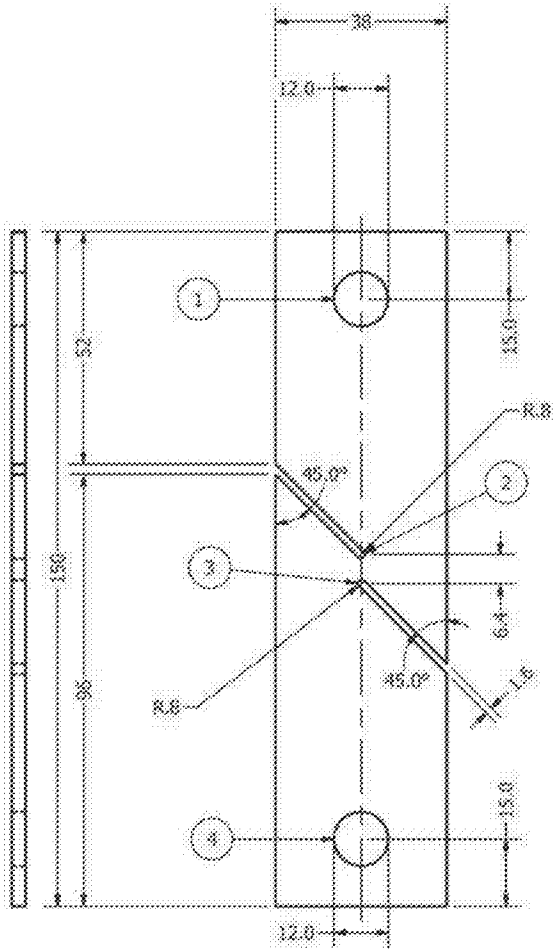
FIG. 10 is a schematic representation of testing conditions described in Example 4.

This test measures the Ultimate Shear Strength:

$$S = \frac{P_{max}}{A},$$

wherein $P_{max}$ is maximum force, A is area of the shear zone, 6.4 mm×sample thickness in FIG. 10. The shear stress rate is not allowed to exceed 689 MPa·min$^{-1}$, ASTM method specifies reporting of the ultimate shear strength.

Calculation of Energy to Failure

Extension to maximum load appears good at first, however the rotation and initial loading of the weaker x615 results in a longer plateau during the first stages of the test. Calculating the energy required to cause failure allows one to ignore this initial loading phenomenon by calculating the area under the shear stress-strain curve. Numerical integration was performed using the trapezoidal method. For the calculation of the energy to failure one first requires sufficient data points of shear stress vs. shear strain. With sufficient data points one can proceed to perform numerical integration using an appropriate Newton-Cotes scheme, for instance the Trapezoidal Rule (SEE Numerical Methods for Engineers: With Software and Programming Applications, Fourth Edition, Steven C. Chapra and Raymond P. Canale, McGraw-Hill 2002). The end result is the total energy expended in Joules during the test.

CONCLUSIONS

Figure 11:
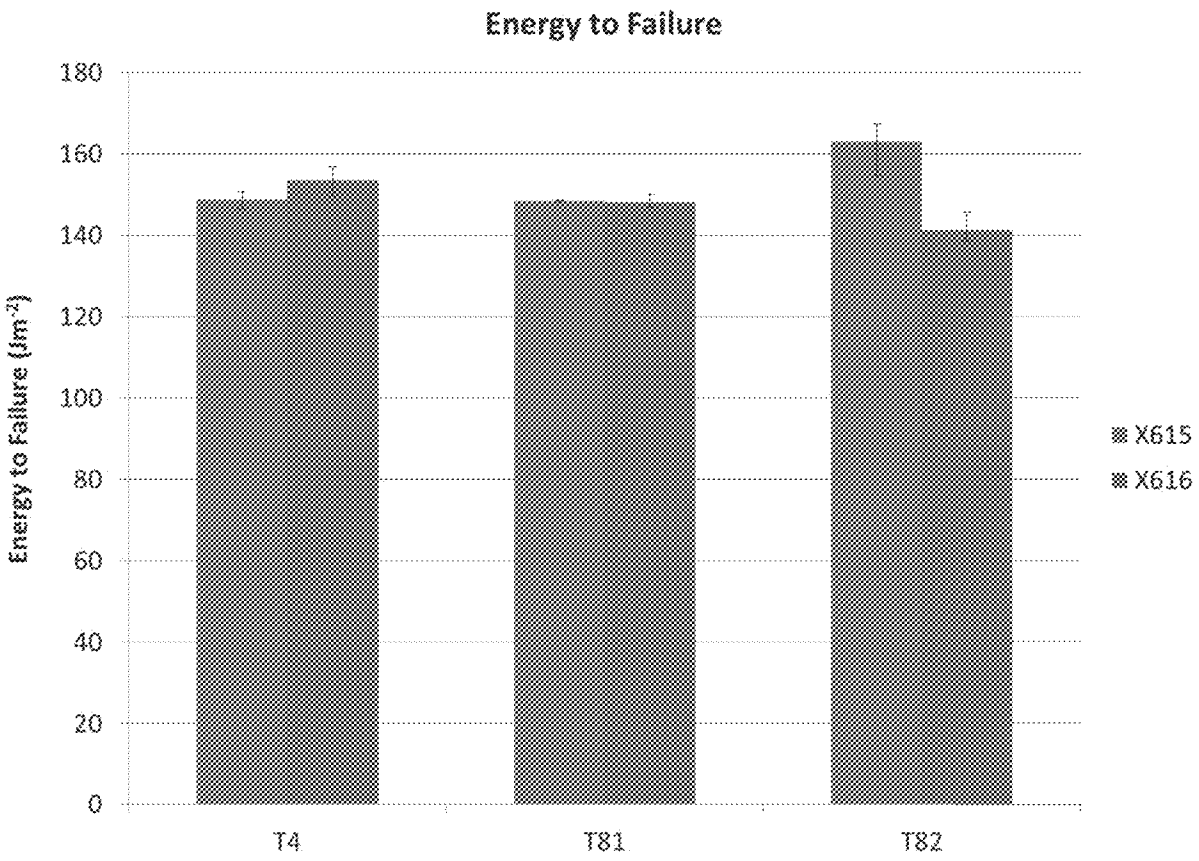
FIG. 11 is a schematic representation of results of ultimate shear strength testing for alloys x615 (left histogram bar in each set) and x616 (right histogram bar in each set) at T4, T81 and T82 tempers.

On first observation, x615 and x616 displayed similar behavior during shear loading, though in T81 condition, x616 had much higher ultimate shear strength. Initial loading plateau of x615 and x616 could be attributable simply due to the higher strength of x616. Energy to failure circumvented this, however, and highlighted a difference between x615 and x616. See FIG. 11. Alloy x615 has a wider SHT temperature range than x616 to obtain r/t values below 0.4. See FIG. 8.

Example 5

Crashworthiness of x615

Tests were performed to assess the crushing behavior, including the crush survivability, energy absorption, and folding behavior, of x615 in the T4, T81, and T82 tempers. The energy absorption of alloy x615 was compared to the energy absorption to alloys 5754 and alloy 6111.

Figure 12A:
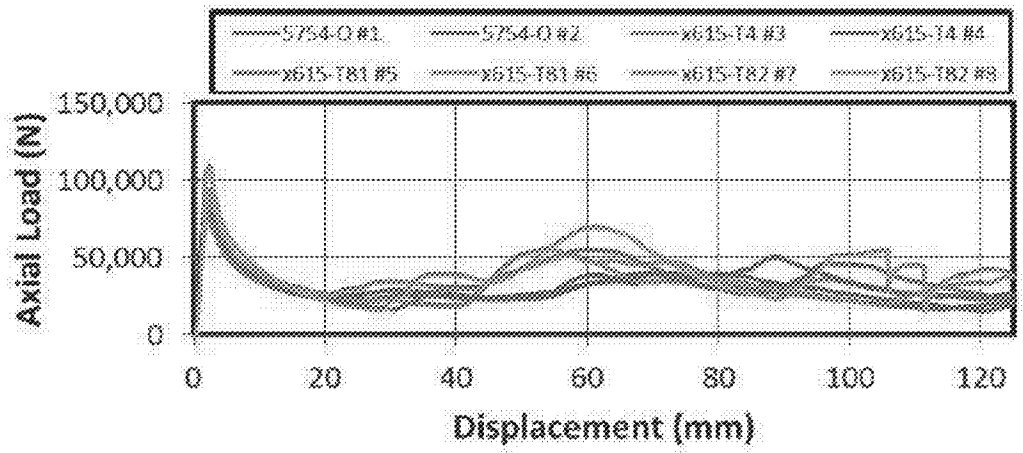
FIG. 12A is an axial load-displacement curve for crush samples prepared from alloy x615 at T4, T81, and T2 tempers and alloy 5754 at O temper.
Figure 12B:
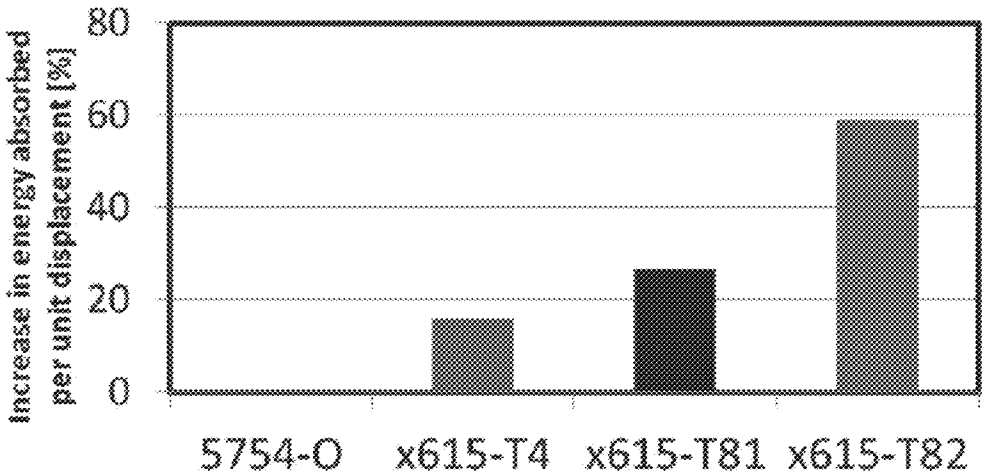
FIG. 12B is a graph showing the energy absorbed per unit displacement for crush samples prepared from alloy x615 at T4, T81, and T2 tempers and alloy 5754 at O temper.
Figure 12C:
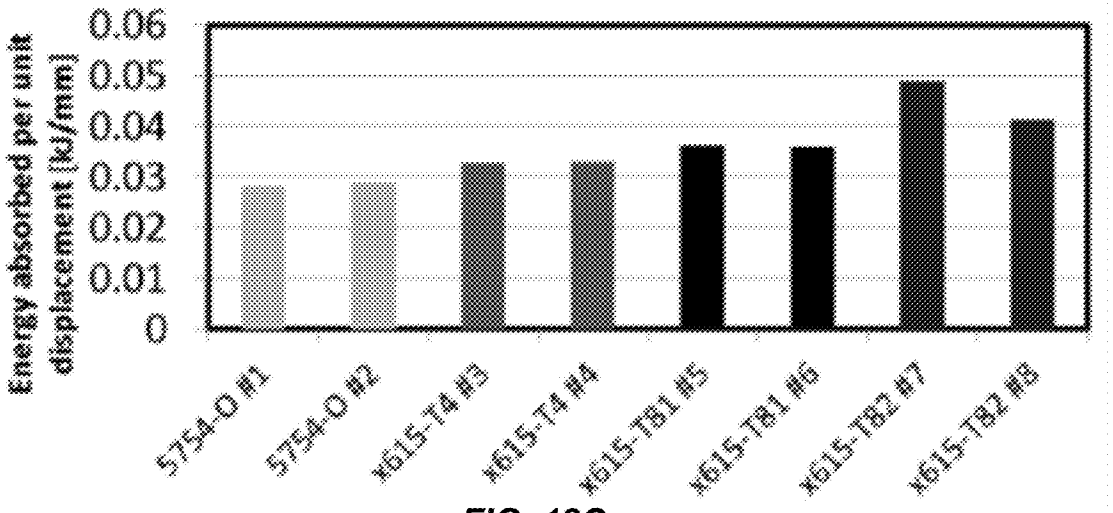
FIG. 12C is a graph showing the increase in energy absorbed per unit displacement for crush samples prepared from alloy x615 at T4, T81, and T2 tempers and alloy 5754 at O temper.
Figure 12D:
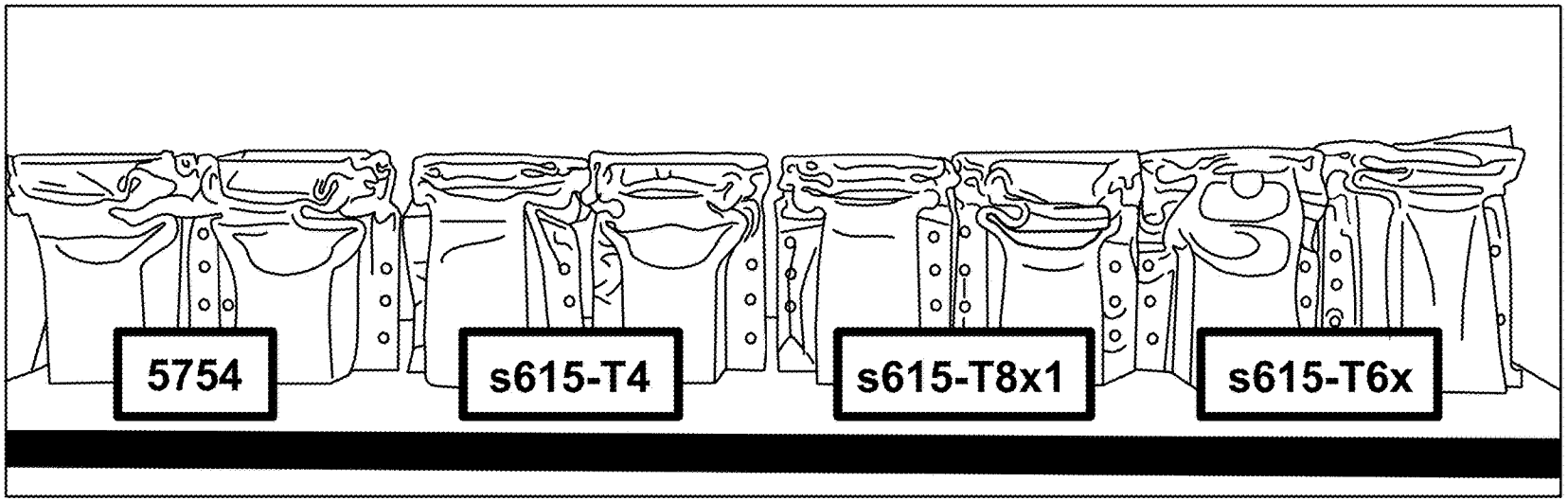
FIG. 12D is a picture of the crush samples prepared from alloy x615 and alloy 5754.

A preliminary tube crush test was performed at a crush depth of 125 mm using a fixture prepared from an x615 alloy sheet, including joints formed from a self-piercing rivet. A 5754 alloy fixture was used for comparison purposes. See FIG. 12D. The corresponding axial load-displacement curve is shown in FIG. 12A. The energy absorbed per unit of displacement for the samples is shown in FIG. 12B. The x615 fixtures in the T4, T81, and T82 tempers showed an increase in energy absorbed per unit displacement, whereas the 5754 sample showed no increase in energy absorbed per unit displacement. See FIG. 12C.

Figure 13A:
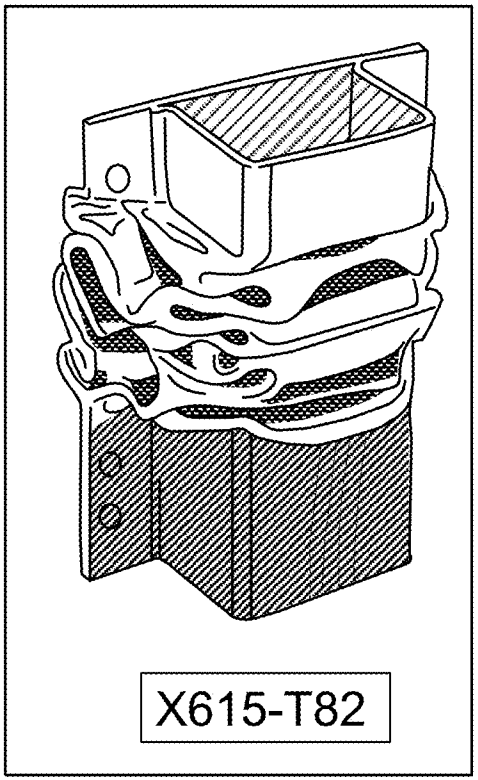
FIG. 13A is a picture of crush samples prepared from alloy x615 in the T81 temper and T82 temper.
Figure 13A:
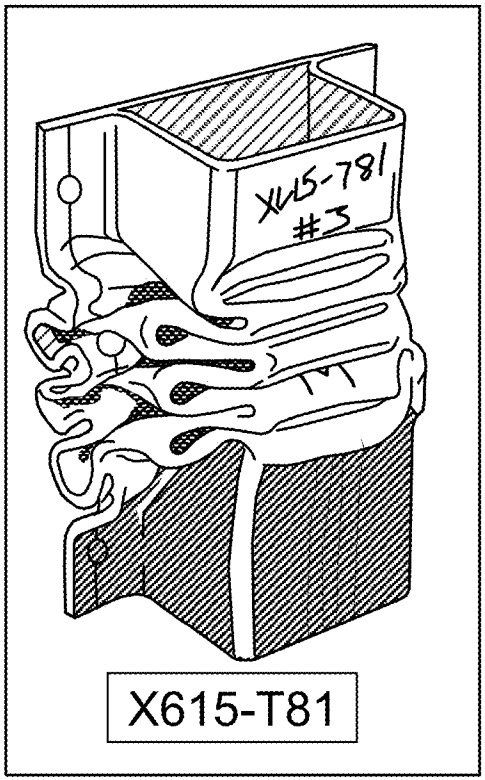
Figure 13B:
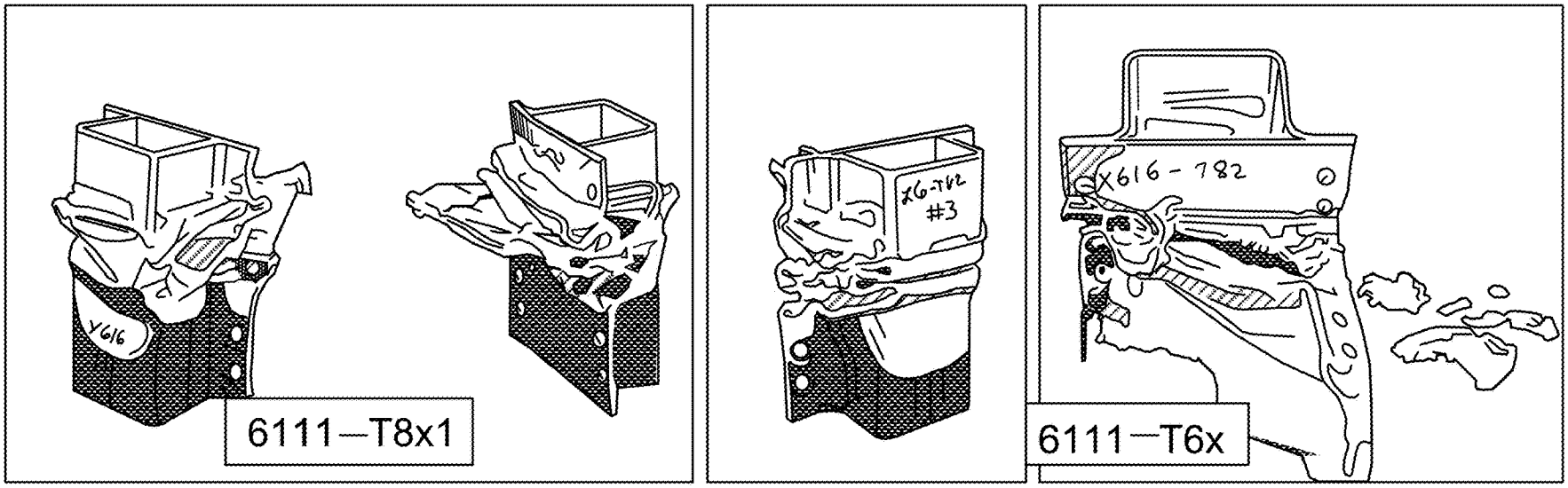
FIG. 13B contains pictures of crush samples prepared from alloy 6111 in the T81 temper and T82 temper (labeled as "T6× temper").

In a second phase crush test, x615 was compared to 6111. A crush test was performed at a crush depth of 220 mm using an x615 alloy fixture in the T81 and T82 tempers and a 6111 alloy fixture in the T81 and T82 tempers, including joints formed from a self-piercing rivet. The x615 fixtures successfully folded upon crushing with no tearing, with superior rivet ability and excellent energy absorption. See FIG. 13A. The 6111 fixtures tore during folding. The rivet ability was inferior at the T82 temper, as the rivet buttons split during crushing. See FIG. 13B, right photo.

Figure 14:
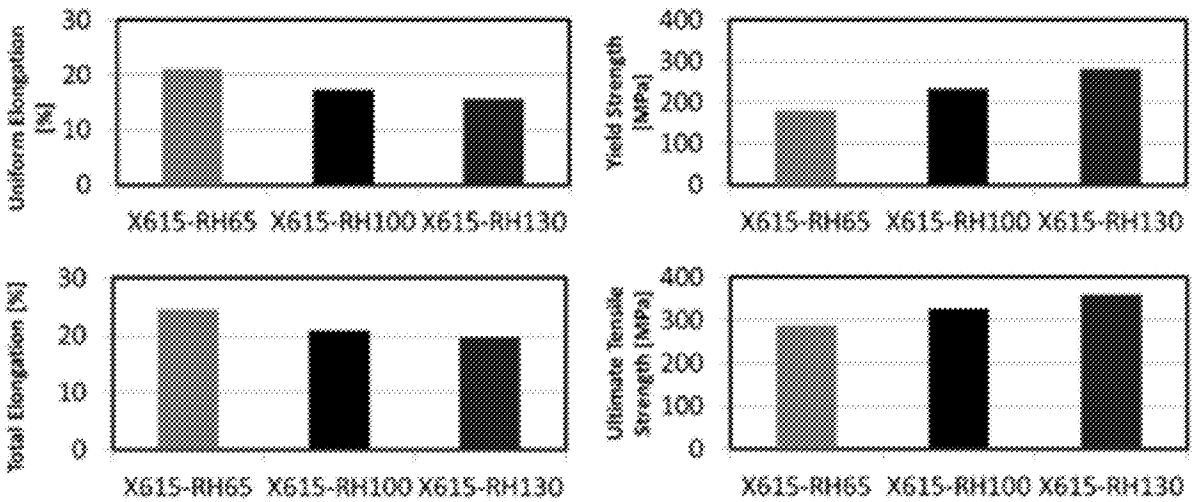
FIG. 14 contains graphs showing the uniform elongation (upper left graph), total elongation (lower left graph), yield strength (upper right graph), and ultimate tensile strength (lower right graph) for the x615 material after reheating the solution heat treated x615 material to 65° C., 100° C., or 130° C.
Figure 15A:
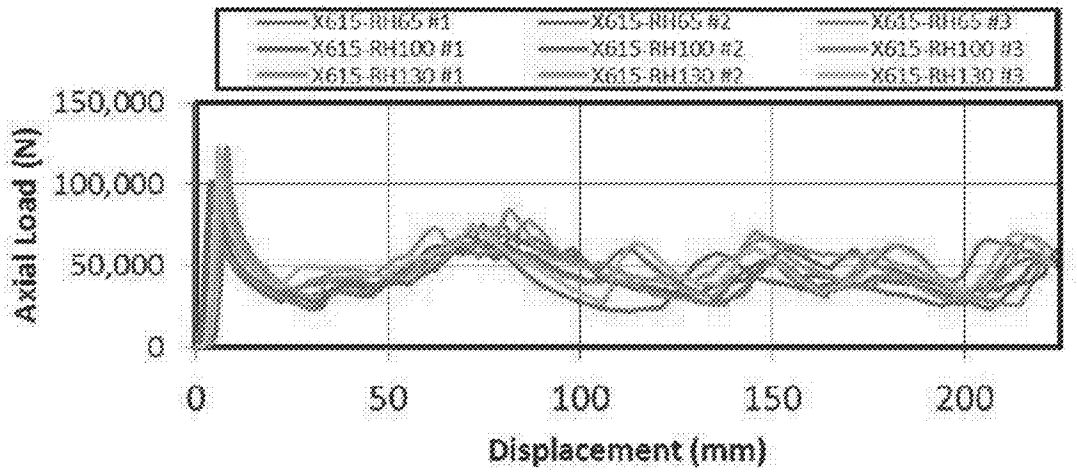
FIG. 15A is an axial load-displacement curve for crush samples prepared from alloy x615 after reheating the solution heat treated x615 material to 65° C., 100° C., or 130° C.
Figure 15B:
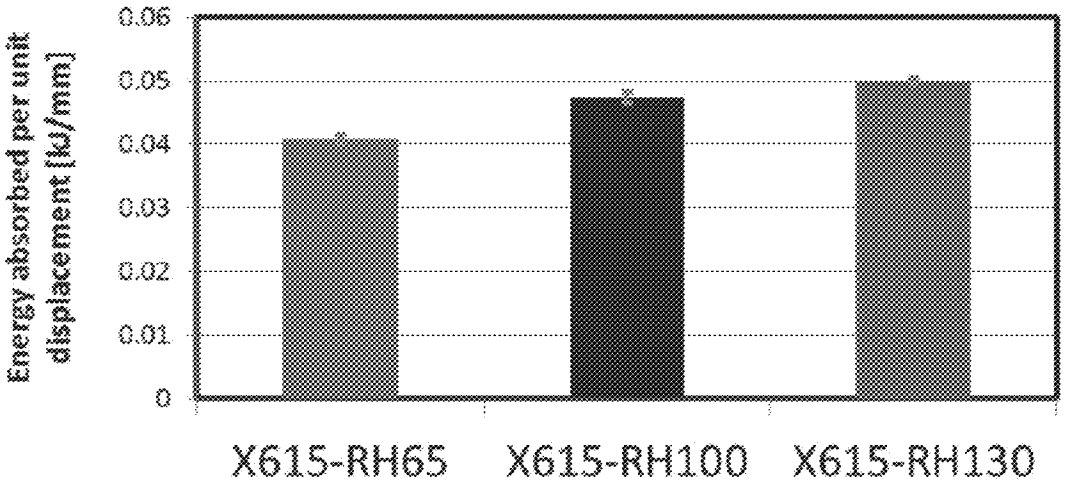
FIG. 15B is a graph showing the energy absorbed per unit displacement for crush samples prepared from alloy x615 after reheating the solution heat treated x615 material to 65° C., 100° C., or 130° C.
Figure 15C:
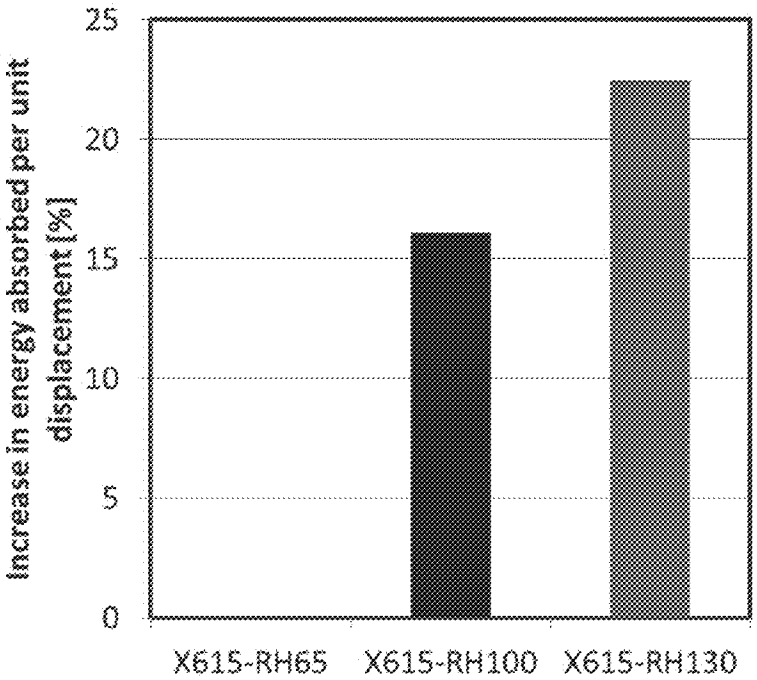
FIG. 15C is a graph showing the increase in energy absorbed per unit displacement for the crush samples prepared from alloy x615 after reheating the solution heat treated x615 material to 65° C., 100° C., or 130° C.
Figure 15D:
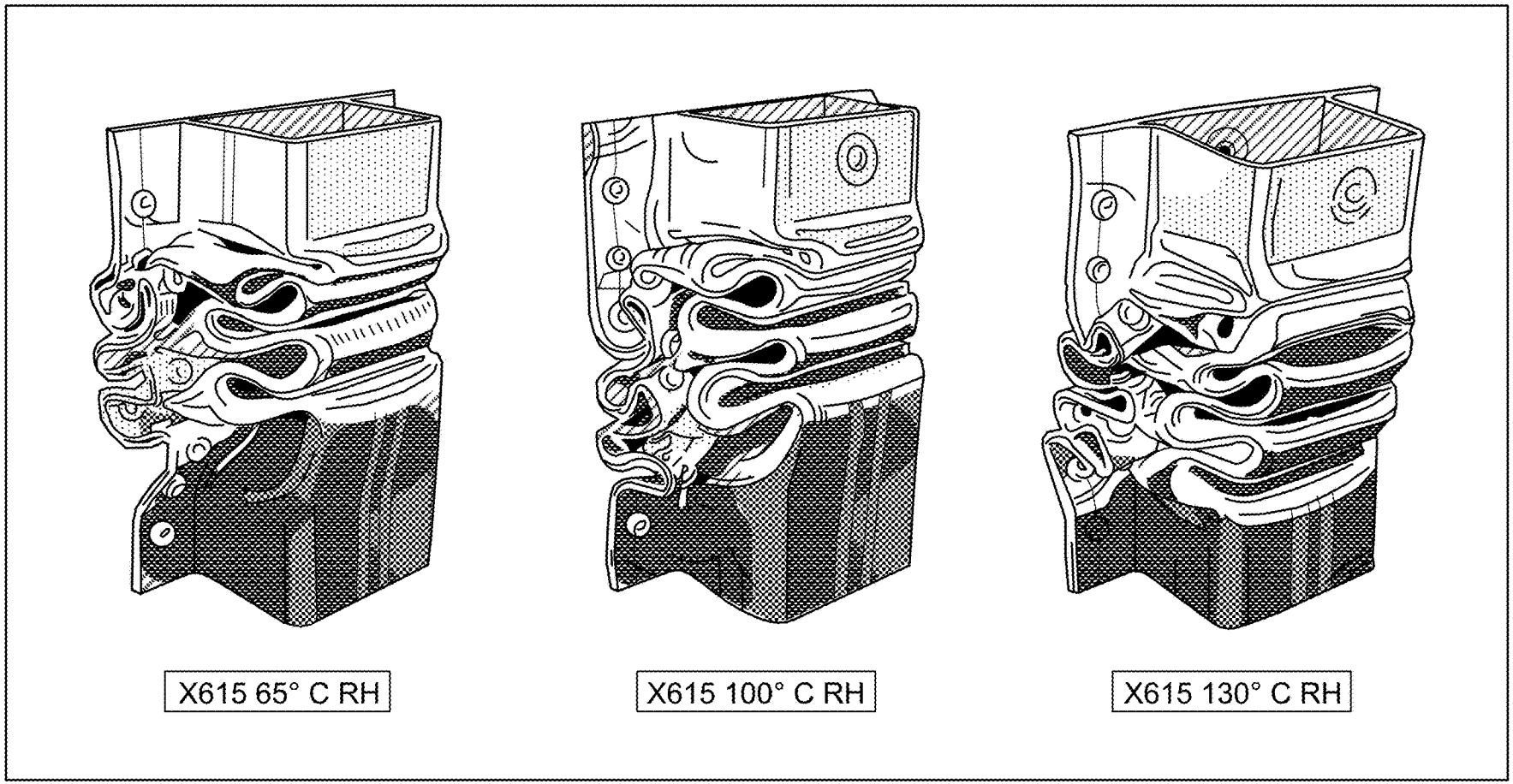
FIG. 15D is a picture of the crush samples prepared from alloy x615 after reheating the solution heat treated x615 material to 65° C., 100° C., or 130° C.

In a third phase crush test, the effect of reheating was determined. After solution heat treating, the x615 material was reheated to 65° C., 100° C., or 130° C. The x615 sheet was paint baked at 180° C. for 20 minutes and the uniform elongation, total elongation, yield strength, and ultimate tensile strength was determined for the x615 material. See FIG. 14. As shown in FIG. 14, this reheating step produces an additional age hardening process that increases both the yield strength (YS) and the ultimate tensile strength (UTS) with a decrease in both the uniform and total elongation, but nonetheless provides for improved performance as determined by the energy per displacement, and with complete integrity of the structure as shown in FIG. 15 D. The fixture was formed and was then aged to the T81 temper. The axial load-displacement curve is shown in FIG. 15A. The energy absorbed per unit of displacement for the samples is shown in FIG. 15B. As shown in FIG. 15C, the x615 fixtures where the x615 sheet was reheated to 100° C. or 130° C. showed an increase in energy absorbed per unit displacement, whereas the x615 sheet reheated to 65° C. showed no increase in energy absorbed per unit displacement. The crush images are shown in FIG. 15D.

Based on the crush tests described above, the crash worthiness of x615 at T4, as well as the post-formed artificially aged material, was superior that that of alloy 5754 and of alloy 6111. The x615 alloy thus provides considerable options for design engineers to tune their structures based on the available strength variants.

All patents, publications and abstracts cited above are incorporated herein by reference in their entirety. Various embodiments of the invention have been described in fulfillment of the various objectives of the invention. It should be recognized that these embodiments are merely illustrative of the principles of the present invention. Numerous modifications and adaptations thereof will be readily apparent to those skilled in the art without departing from the spirit and scope of the present invention as defined in the following claims.

What is claimed is:

1. An aluminum alloy sheet, comprising Cu 0.40-0.80 wt. %, Fe 0-0.40 wt. %, Mg 0.40-0.8 wt. %, Mn 0-0.40 wt. %, Si 0.40-0.7 wt. %, Cr 0-0.2 wt. %, Zn 0-0.1 wt. % and Ti 0-0.20 wt. % with trace element impurities 0.10 wt. % maximum, and Al, wherein the aluminum alloy sheet has a yield strength of at least 300 MPa and an r/t bendability ratio of 0.8 or less, wherein the aluminum alloy sheet comprises a plurality of dispersoid particles having an average size from 0.008 $\mu m^2$ to 2 $\mu m^2$, and wherein a number of dispersoid particles per 200 $\mu m^2$ is greater than 500 particles.

2. The aluminum alloy sheet of claim 1, comprising Cu 0.45-0.75 wt. %, Fe 0.1-0.35 wt. %, Mg 0.45-0.8 wt. %, Mn 0.1-0.35 wt. %, Si 0.45-0.65 wt. %, Cr 0.02-0.18 wt. %, Zn 0-0.1 wt. % and Ti 0.05-0.15 wt. % with trace element impurities 0.10 wt. % maximum, and Al.

3. The aluminum alloy sheet of claim 1, comprising Cu 0.45-0.65 wt. %, Fe 0.1-0.3 wt. %, Mg 0.5-0.8 wt. %, Mn 0.15-0.35 wt. %, Si 0.45-0.65 wt. %, Cr 0.02-0.14 wt. %, Zn 0.0-0.1 wt. % and Ti 0.05-0.12 wt. % with trace element impurities 0.10 wt. % maximum, and Al.

4. The aluminum alloy sheet of claim 1, comprising Cu 0.51-0.59 wt. %, Fe 0.22-0.26 wt. %, Mg 0.66-0.74 wt. %, Mn 0.18-0.22 wt. %, Si 0.57-0.63 wt. %, Cr 0.06-0.1 wt. %, Zn 0.0-0.1 wt. % and Ti 0-0.08 wt. % with trace element impurities 0.10 wt. % maximum, and Al.

5. The aluminum alloy sheet of claim 1, comprising Cu 0.51-0.59 wt. %, Fe 0.22-0.26 wt. %, Mg 0.66-0.74 wt. %, Mn 0.18-0.22 wt. %, Si 0.55-0.6 wt. %, Cr 0.06-0.1 wt. %, Zn 0.0-0.1 wt. % and Ti 0-0.08 wt. % with trace element impurities 0.10 wt. % maximum, and Al.

6. The aluminum alloy sheet of claim 1, having sufficient ductility or toughness to meet an r/t bendability of 0.4 or less.

7. An automotive body part comprising the aluminum alloy sheet of claim 1.

8. The aluminum alloy sheet of claim 1, wherein the number of dispersoid particles per 200 $\mu m^2$ is greater than 1000 particles.

9. The aluminum alloy sheet of claim 1, wherein the aluminum alloy sheet comprises from 0 wt. % to 0.10 wt. % excess Si for forming $Mg_2Si$.

10. An aluminum alloy sheet, comprising Cu 0.45-0.65 wt. %, Fe 0-0.40 wt. %, Mg 0.40-0.8 wt. %, Mn 0-0.40 wt. %, Si 0.40-0.7 wt. %, Cr 0-0.2 wt. %, Zn 0-0.1 wt. % and Ti 0-0.20 wt. % with trace element impurities 0.10 wt. % maximum, and Al, wherein the aluminum alloy sheet has a yield strength of at least 300 MPa and an r/t bendability ratio of 0.8 or less, wherein the aluminum alloy sheet comprises a plurality of dispersoid particles having an average size from 0.008 $\mu m^2$ to 2 $\mu m^2$, and wherein a number of dispersoid particles per 200 $\mu m^2$ is greater than 500 particles.

11. The aluminum alloy sheet of claim 10, wherein the aluminum alloy sheet comprises from 0 wt. % to 0.10 wt. % excess Si for forming $Mg_2Si$.

* * * * *